US012606394B2

(12) United States Patent
Kumagai

(10) Patent No.: US 12,606,394 B2
(45) Date of Patent: Apr. 21, 2026

(54) MEDIUM FEEDING DEVICE, RECORDING DEVICE, FEEDING ROLLER UNIT, AND METHOD OF CONTROLLING RECORDING DEVICE

(71) Applicant: SEIKO EPSON CORPORATION, Tokyo (JP)

(72) Inventor: Katsunari Kumagai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 64 days.

(21) Appl. No.: 18/616,976

(22) Filed: Mar. 26, 2024

(65) Prior Publication Data

US 2024/0327156 A1 Oct. 3, 2024

(30) Foreign Application Priority Data

Mar. 29, 2023 (JP) ..... 2023-054130

(51) Int. Cl.
*B65H 3/06* (2006.01)
*B65H 7/02* (2006.01)

(52) U.S. Cl.
CPC ..... *B65H 3/0684* (2013.01); *B65H 3/0669* (2013.01); *B65H 7/02* (2013.01); *B65H 2403/72* (2013.01); *B65H 2403/732* (2013.01); *B65H 2404/152* (2013.01); *B65H 2801/06* (2013.01)

(58) Field of Classification Search
CPC .... B65H 3/0669; B65H 3/0684; B65H 3/068; B65H 3/06; B65H 3/54
See application file for complete search history.

(56) References Cited

U.S. PATENT DOCUMENTS

| | | | | |
|---|---|---|---|---|
| 7,648,134 | B2 * | 1/2010 | Lim | B65H 3/0684 271/118 |
| 9,221,634 | B2 * | 12/2015 | Tanaka | B65H 3/0669 |
| 10,280,018 | B2 * | 5/2019 | Kondo | B65H 3/0669 |
| 10,466,626 | B2 * | 11/2019 | Yang | G03G 15/2064 |
| 2009/0014940 | A1 * | 1/2009 | Lim | B65H 3/0684 271/275 |
| 2016/0046456 | A1 * | 2/2016 | Woo | B65H 3/0684 271/147 |
| 2022/0267107 | A1 * | 8/2022 | Nukui | B65H 3/0661 |

FOREIGN PATENT DOCUMENTS

| | | |
|---|---|---|
| JP | 2001-302006 A | 10/2001 |
| JP | 2016-179897 A | 10/2016 |

* cited by examiner

*Primary Examiner* — Patrick Cicchino
(74) *Attorney, Agent, or Firm* — WORKMAN NYDEGGER

(57) ABSTRACT

A feeding roller feeds a medium placed at a medium placement portion by forward rotation power supplied from a driving unit. A displacement portion displaces the feeding roller to an abutting position by the forward rotation power supplied from the driving unit and displaces the feeding roller to a separation position by reverse rotation power supplied from the driving unit. A power transmission unit includes a one-way clutch that transmits the forward rotation power, that is supplied from the driving unit, to the feeding roller but does not transmit the reverse rotation power, that is supplied from the driving unit, to the feeding roller.

17 Claims, 12 Drawing Sheets

MEDIUM FEEDING DEVICE, RECORDING DEVICE, FEEDING ROLLER UNIT, AND METHOD OF CONTROLLING RECORDING DEVICE

The present application is based on, and claims priority from JP Application Serial Number 2023-054130, filed Mar. 29, 2023, the disclosure of which is hereby incorporated by reference herein in its entirety.

BACKGROUND

1. Technical Field

The present disclosure relates to a medium feeding device, a recording device, a feeding roller unit, and a method of controlling the recording device.

2. Related Art

For example, JP-A-2016-179897 discloses a medium feeding device including a feeding roller that feeds a medium placed at a medium placement portion and a contact prevention portion that prevents the feeding roller from coming into contact with the medium. In such a medium feeding device, the contact prevention portion is configured to retract from between the medium and the feeding roller in association with forward rotation of the feeding roller. In this manner, contact of the feeding roller with the medium is curbed by the contact prevention portion, and thus it is possible to curb bleed marks due to the feeding roller.

However, in such a recording device, it is necessary to reversely rotate the feeding roller when the contact prevention portion is moved between the medium and the feeding roller. For this reason, there is a concern that the alignment of the medium may be impaired due to the reverse rotation of the feeding roller.

SUMMARY

In order to solve the above-described problems, there is provided a medium feeding device including a feeding roller configured to feed a medium placed at a medium placement portion, a driving unit configured to drive the feeding roller, a displacement portion configured to displace the feeding roller between an abutting position and a separation position, and a power transmission unit configured to transmit power, that is supplied from the driving unit, to the feeding roller and the displacement portion, in which the abutting position is a position at which the feeding roller abuts on the medium placed at the medium placement portion, the separation position is a position at which the feeding roller is separated from the medium placed at the medium placement portion, the feeding roller feeds the medium placed at the medium placement portion by forward rotation power supplied from the driving unit, and the displacement portion displaces the feeding roller to the abutting position by the forward rotation power supplied from the driving unit and displaces the feeding roller to the separation position by reverse rotation power supplied from the driving unit, and the power transmission unit includes a one-way clutch that transmits the forward rotation power supplied from the driving unit to the feeding roller but does not transmit the reverse rotation power supplied from the driving unit to the feeding roller.

In order to solve the above-described problems, there is provided a recording device including the medium feeding device, and a recording unit configured to perform recording on a medium fed by the feeding roller.

In order to solve the above-described problems, there is provided a feeding roller unit including a feeding roller configured to feed a medium placed at a medium placement portion, a displacement portion configured to displace the feeding roller between an abutting position and a separation position, and a power transmission unit configured to transmit power, that is supplied from a driving unit, to the feeding roller and the displacement portion, in which the abutting position is a position at which the feeding roller abuts on the medium placed at the medium placement portion, the separation position is a position at which the feeding roller is separated from the medium placed at the medium placement portion, the feeding roller feeds the medium placed at the medium placement portion by forward rotation power supplied from the driving unit, and the displacement portion displaces the feeding roller to the abutting position by the forward rotation power supplied from the driving unit and displaces the feeding roller to the separation position by reverse rotation power supplied from the driving unit, and the power transmission unit includes a one-way clutch that transmits the forward rotation power supplied from the driving unit to the feeding roller but does not transmit the reverse rotation power supplied from the driving unit to the feeding roller.

In order to solve the above-described problems, there is provided a method of controlling the recording device, in which the displacement portion is displaceable between a first position and a second position, the first position is a position at which the feeding roller is displaced to the abutting position, the second position is a position at which the feeding roller is displaced to the separation position, and the method includes displacing the displacement portion to the second position in at least one of a case in which there is no job after termination of a job for performing recording on a medium, a case in which there is no next job for a predetermined period of time after termination of a job for performing recording on a medium, and a case in which power is shut off.

DESCRIPTION OF EMBODIMENTS

First Embodiment

Hereinafter, an embodiment of a medium feeding device, a recording device, a feeding roller unit, and a method of controlling the recording device will be described. The recording device includes the medium feeding device. The medium feeding device includes the feeding roller unit. In the following description, a direction intersecting a vertical direction Z is referred to as a width direction X, and a direction intersecting the vertical direction Z and the width direction X is referred to as a front-back direction Y. One side in the width direction X is referred to as a first width direction X1, and the other side in the width direction X is referred to as a second width direction X2. One side in the front-back direction Y is referred to as a front side Y1, and the other side in the front-back direction Y is referred to as a rear side Y2. The upper side in the vertical direction Z is referred to as an upper side Z1, and the lower side in the vertical direction Z is referred to as a lower side Z2.

Configuration of Recording Device 11

Figure 1:
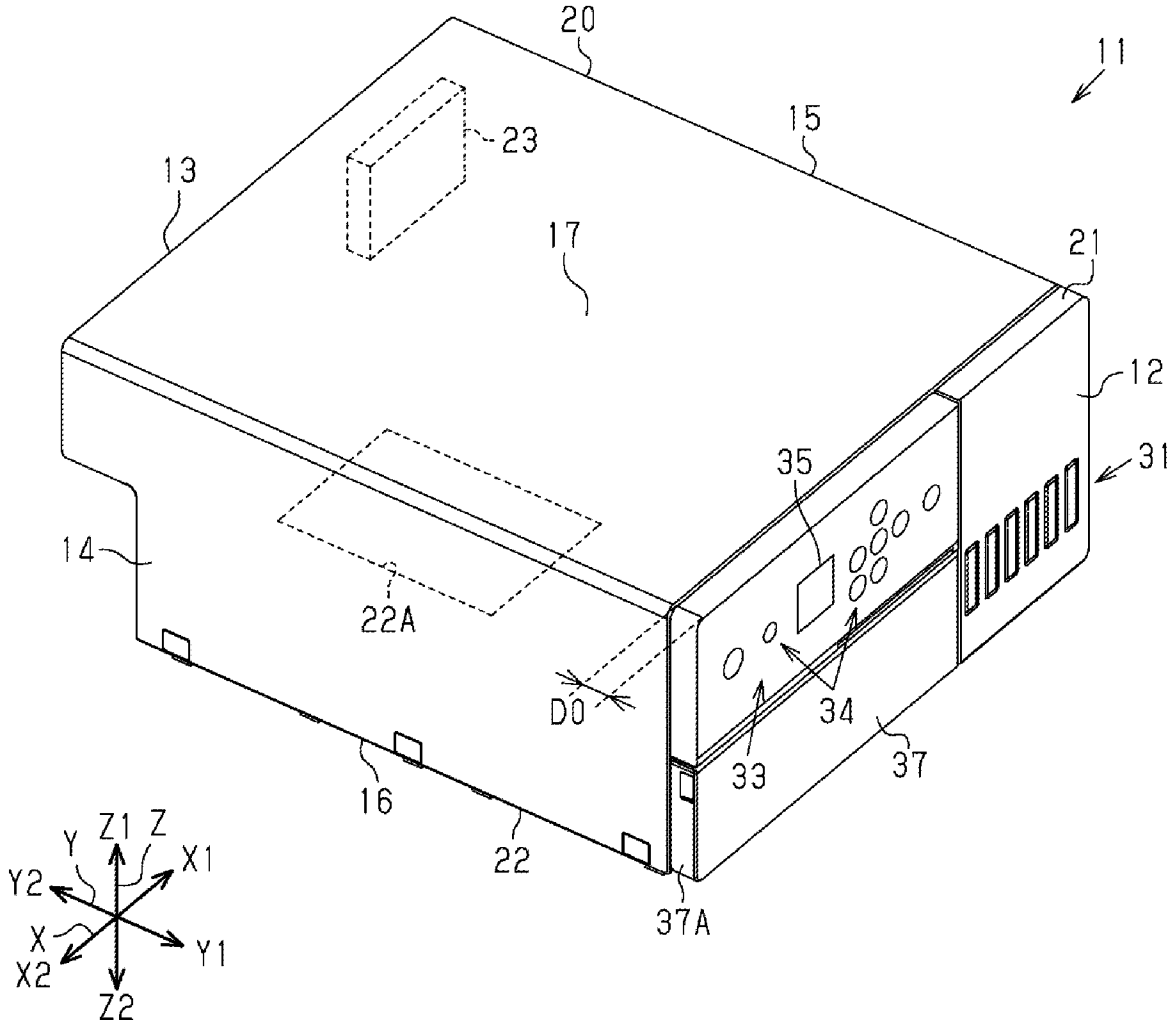
FIG. 1 is a perspective view illustrating a recording device according to a first embodiment.

As illustrated in FIG. 1, a recording device 11 is a device that performs recording on a medium. The recording device 11 may be a device that performs recording on a medium by ejecting liquid. The liquid may be, for example, ink. The liquid may be, for example, a plurality of types of colors or one type of color. The medium may be, for example, a sheet. The paper includes photographic paper 99 to be described later. The recording device 11 may be a device capable of performing recording on a plurality of types of sheets.

The recording device 11 is formed in a rectangular parallelepiped shape. The recording device 11 includes a front surface 12. The front surface 12 is a plane facing the front side Y1. The recording device 11 includes a back surface 13. The back surface 13 is a plane facing the rear side Y2. The recording device 11 includes a left side surface 14. The left side surface 14 is a plane facing in the second width direction X2. The recording device 11 includes a right side surface 15. The right side surface 15 is a plane facing in the first width direction X1. The recording device 11 includes a bottom surface 16. The bottom surface 16 is a plane facing the lower side Z2. The recording device 11 includes a top surface 17. The top surface 17 is a plane facing the upper side Z1.

As described above, the top surface 17 includes a flat surface on which a loading target can be loaded. The loading target may be another recording device 11 or may be a notebook computer. The top surface 17 may be a flat surface in the entire region or may not be a flat surface in a portion of a region as long as the top surface 17 includes a flat surface on which a loading target can be loaded.

The recording device 11 includes a housing 20 and a main body 21. The housing 20 is configured to accommodate the main body 21. The housing 20 constitutes at least a portion of the left side surface 14, a portion of the right side surface 15, a portion of the bottom surface 16, and a portion of the top surface 17 of the recording device 11, but may constitute at least the entire left side surface 14, the entire right side surface 15, the entire bottom surface 16, and the entire top surface 17 of the recording device 11.

As described above, the housing 20 has a plurality of surfaces of the left side surface 14, the right side surface 15, the bottom surface 16, and the top surface 17 of the recording device 11. The left side surface 14, the right side surface 15, the bottom surface 16, and the top surface 17 of the recording device 11 can also be referred to as a left side surface, a right side surface, a bottom surface, and a top surface of the housing 20, respectively. At least a portion of the front surface 12 of the recording device 11 may be included in the housing 20. At least a portion of the back surface 13 of the recording device 11 may be included in the housing 20.

The main body 21 constitutes at least the entire front surface 12 of the recording device 11, but may constitute at least a portion of the front surface 12 of the recording device 11. As described above, the main body 21 has the front surface 12 of the recording device 11. It can also be said that the front surface 12 of the recording device 11 is a front surface of the main body 21. The back surface 13 of the recording device 11 may be constituted by the back surface of the housing 20 and the back surface of the main body 21, may be constituted by only the back surface of the housing 20, and may be constituted by only the back surface of the main body 21.

The housing 20 includes a bottom plate 22 having a flat plate shape. The bottom plate 22 is made of a metal, but may be made of a resin or may be constituted by both a metal plate and a resin plate. The bottom plate 22 includes a through hole 22A. The through hole 22A opens in the bottom plate 22 in the vertical direction Z. The through hole 22A is a hole for attaching and detaching a member accommodated in the housing 20 from the lower side Z2 of the bottom plate 22.

The recording device 11 includes an accommodation amount visual recognition unit 31. The accommodation amount visual recognition unit 31 is provided in the main body 21. The accommodation amount visual recognition unit 31 allows visual recognition of the amount of liquid accommodated in a liquid accommodation unit 40 to be described later. The accommodation amount visual recognition unit 31 is constituted by a plurality of visual recognition windows respectively corresponding to liquids of respective colors.

The recording device 11 includes an operation panel 33. The operation panel 33 is provided in the main body 21. The operation panel 33 includes an operation unit 34 and a display unit 35. The operation unit 34 can be operated by a user. The operation unit 34 may be constituted by a plurality of operation buttons. The display unit 35 displays information regarding the recording device 11. The operation panel 33 is positioned on the front surface 12 of the recording device 11.

The main body 21 is configured to be displaceable in the front-back direction Y with respect to the housing 20. Specifically, the main body 21 is configured to be displaceable between a closed position, a first open position, and a second open position in the front-back direction Y with respect to the housing 20.

The main body 21 can be disposed at the closed position. The closed position is a position at which the main body 21 is accommodated in the housing 20. The closed position is a position at which the main body 21 protrudes from the housing 20 by a predetermined distance DO toward the front side Y1, but may be a position at which the main body 21 does not protrude from the housing 20. That is, the main body 21 constitutes a portion of the left side surface 14, a portion of the right side surface 15, a portion of the bottom surface 16, and a portion of the top surface 17 of the recording device 11, but may not constitute the left side surface 14, the right side surface 15, the bottom surface 16, and the top surface 17 of the recording device 11.

Figure 2:
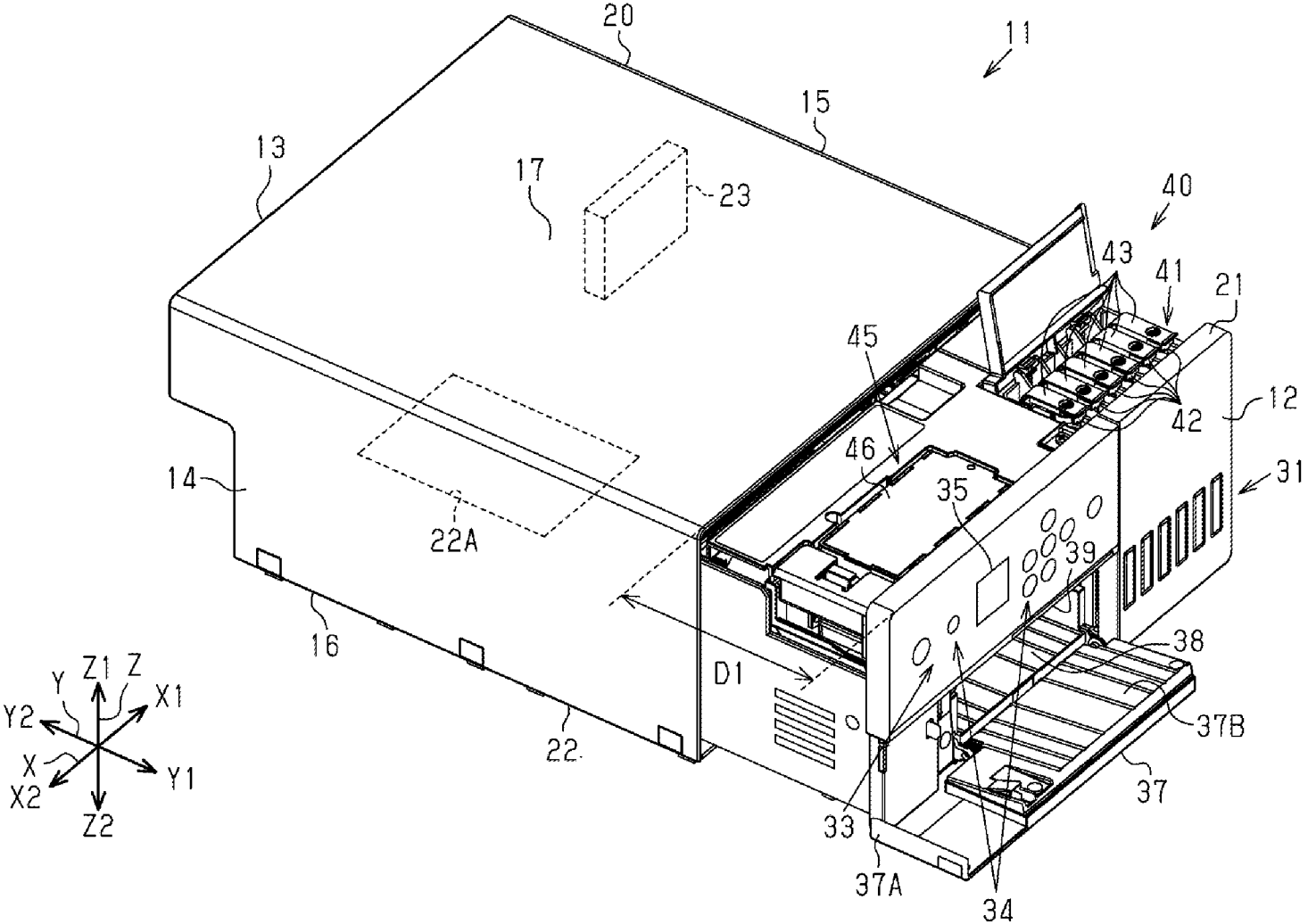
FIG. 2 is a perspective view illustrating the recording device according to the first embodiment.

As illustrated in FIG. 2, the main body 21 is displaceable to the first open position. The first open position is an open position at which the main body 21 protrudes from the housing 20 toward the front side Y1. In particular, the first open position is a position at which the main body 21 protrudes from the housing 20 toward the front side Y1 by a first distance D1. The first distance D1 is a distance longer than the predetermined distance DO. In this manner, when the main body 21 is disposed at the first open position, at least a portion of the inside of the main body 21 is exposed from the housing 20.

Figure 3:
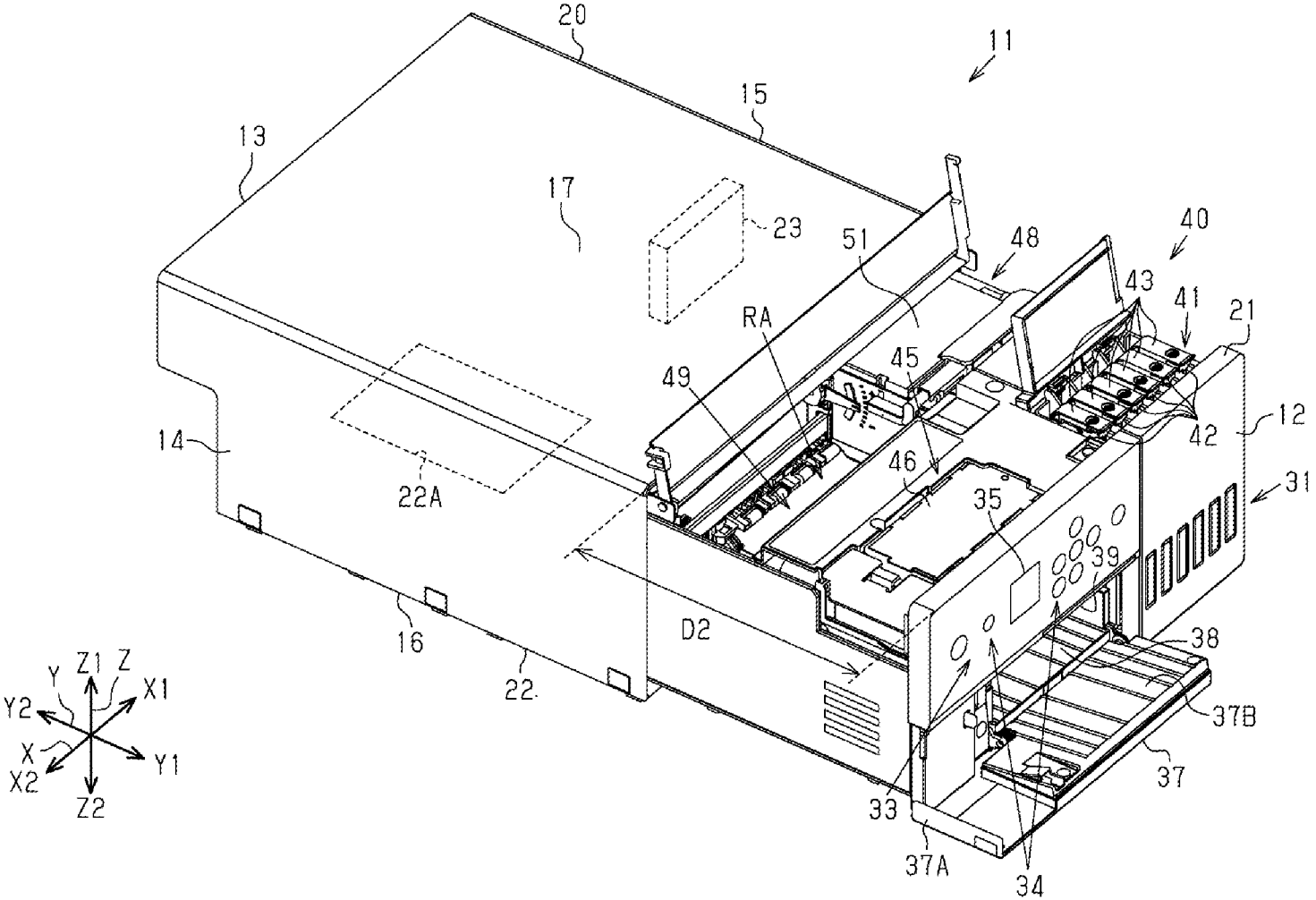
FIG. 3 is a perspective view illustrating the recording device according to the first embodiment.

As illustrated in FIG. 3, the main body 21 is displaceable to the second open position. The second open position is an open position at which the main body 21 protrudes from the housing 20 toward the front side Y1. In particular, the second open position is a position at which the main body 21 protrudes from the housing 20 toward the front side Y1 by a second distance D2. The second distance D2 is a distance longer than the first distance D1. In this manner, when the main body 21 is disposed at the second open position, at least a portion of the inside of the main body 21 is exposed from the housing 20.

The recording device 11 includes a control unit 23. The control unit 23 is mounted on the main body 21. The control unit 23 is accommodated in the housing 20. The control unit 23 is not exposed from the housing 20 when the main body 21 is disposed at the closed position, the first open position, and the second open position.

The control unit 23 controls the recording device 11. The control unit 23 controls various operations performed by the recording device 11. The control unit 23 can be configured as a circuit including a: one or more processors that execute various processes in accordance with a computer program, B: one or more dedicated hardware circuits that execute at least some of the various processes, or γ: a combination thereof. The hardware circuit is, for example, an application-specific integrated circuit. The processor includes a CPU, and a memory such as a RAM and a ROM, and the memory stores program codes or instructions configured to cause the CPU to execute processes. The memory, that is, a computer-readable medium, includes any readable medium that can be accessed by a general purpose or dedicated computer.

The recording device 11 includes an opening/closing unit 37. The opening/closing unit 37 is provided in the main body 21. The opening/closing unit 37 is positioned on the front surface 12 of the recording device 11. The opening/closing unit 37 is configured to be rotatable around a rotation shaft in a width direction X in a lower end portion 37A. Thereby, the opening/closing unit 37 is configured to be openable and closable with respect to the front surface 12 of the recording device 11.

The recording device 11 includes a discharge port 38. The discharge port 38 is provided in the main body 21. The discharge port 38 is an opening through which a medium is discharged, the medium being a medium on which recording has been performed by a recording unit 48 to be described below. The discharge port 38 opens on the front side Y1 of the recording device 11. That is, the discharge port 38 is provided to open on the front side Y1 on the front surface 12 of the recording device 11. In other words, the discharge port 38 is provided to open on the front side Y1 on the front surface of the main body 21.

The discharge port 38 is exposed on the front side Y1 of the recording device 11 when the opening/closing unit 37 is opened. The discharge port 38 is not exposed when the opening/closing unit 37 is closed, but may be exposed also when the opening/closing unit 37 is closed. The discharge port 38 is positioned in the second width direction X2 of the liquid accommodation unit 40 to be described later.

The recording device 11 includes a sheet discharge tray 37B. The sheet discharge tray 37B is provided in the main body 21. The sheet discharge tray 37B is provided on an inner wall surface of the opening/closing unit 37. The sheet discharge tray 37B is exposed when the opening/closing unit 37 is opened, and media after recording can be placed thereon. The sheet discharge tray 37B may be configured to be expandable and contractible in the front-back direction Y.

The recording device 11 includes a grip portion 39. The grip portion 39 is provided in the main body 21. The grip portion 39 is provided on the upper side Z1 of the discharge port 38. The grip portion 39 is provided on the front surface 12 of the recording device 11 at a position where the user can grip the grip portion 39 from the front side Y1. That is, the grip portion 39 is provided on the surface of the main body 21 facing the front side Y1 at a position where the user can grip the grip portion 39 from the front side Y1. In this manner, the grip portion 39 can be gripped by the user when the main body 21 is displaced in the front-back direction Y. In particular, even when a plurality of recording devices 11 are stacked in the vertical direction Z or when a plurality of recording devices 11 are installed side by side in the width direction X, the grip portion 39 can be easily gripped by the user from the front side Y1.

As illustrated in FIG. 2, the recording device 11 includes the liquid accommodation unit 40. The liquid accommodation unit 40 is mounted on the main body 21. The liquid accommodation unit 40 is configured to accommodate liquid used for recording on a medium. That is, the liquid accommodation unit 40 is configured to accommodate liquid to be supplied to the recording unit 48 to be described later. The liquid accommodation unit 40 may be a tank-type accommodation unit into which liquid can be injected.

The liquid accommodation unit 40 includes an accommodation chamber 41, a liquid injection port 42, and a cap 43. The accommodation chamber 41 is configured to accommodate liquid. The liquid injection port 42 is an opening configured to allow liquid to be injected into the accommodation chamber 41. The cap 43 covers the liquid injection port 42. The cap 43 can prevent the accommodation chamber 41 from being dried by sealing the accommodation chamber 41. By removing the cap 43 from the liquid injection port 42, liquid can be injected into the accommodation chamber 41 from the liquid injection port 42. The liquid accommodation unit 40 may include a plurality of accommodation chambers 41, a plurality of liquid injection ports 42, and a plurality of caps 43 corresponding to liquids of respective colors.

The liquid accommodation unit 40 is not exposed from the housing 20 when the main body 21 is disposed at the closed position. The liquid accommodation unit 40 is exposed from the housing 20 when the main body 21 is disposed at the first open position. In this manner, when the main body 21 is disposed at the first open position, the liquid injection port 42 is exposed from the housing 20 by removing the cap 43. Thereby, liquid can be injected into the accommodation chamber 41 from the liquid injection port 42. The liquid accommodation unit 40 is also exposed from the housing 20 when the main body 21 is disposed at the second open position.

The recording device 11 includes a waste liquid mounting portion 45. The waste liquid mounting portion 45 is configured such that a waste liquid accommodation body 46 can be mounted thereon. The waste liquid accommodation body 46 is configured to be capable of collecting liquid discharged as waste liquid from the recording unit 48 to be described later via a maintenance device which is not illustrated in the drawing. The waste liquid mounting portion 45 is mounted on the main body 21. The waste liquid mounting portion 45 is provided on the upper side Z1 of the discharge port 38.

The waste liquid mounting portion 45 is not exposed from the housing 20 when the main body 21 is disposed at the closed position. The waste liquid mounting portion 45 is exposed from the housing 20 when the main body 21 is disposed at the first open position. In this manner, when the main body 21 is disposed at the first open position, the waste liquid mounting portion 45 is exposed from the housing 20. Thereby, the waste liquid accommodation body 46 can be attached to and detached from the waste liquid mounting portion 45. The waste liquid mounting portion 45 is also exposed from the housing 20 when the main body 21 is disposed at the second open position.

As illustrated in FIG. 3, the recording device 11 includes the recording unit 48. The recording unit 48 is configured to perform recording on a medium. The recording unit 48 may be configured to perform recording on a medium by discharging liquid onto the medium. The recording unit 48 is mounted on the main body 21. The recording unit 48 is provided at a position adjacent to the liquid accommodation unit 40 in the front-back direction Y. The recording unit 48 is provided on the rear side Y2 from the liquid accommodation unit 40.

The recording unit 48 is exposed from the housing 20 when the main body 21 is disposed at the second open position. In particular, a carriage 51 to be described later is exposed from the housing 20 when the main body 21 is disposed at the second open position. The recording unit 48 is not exposed from the housing 20 when the main body 21 is disposed at the closed position and the first open position.

The recording device 11 includes a conveyance path 49. The conveyance path 49 is a path for conveying a medium. The conveyance path 49 is provided in the main body 21. A portion of the conveyance path 49 is exposed from the housing 20 when the main body 21 is located at the second open position. In particular, in the conveyance path 49, a recording region RA in which recording is performed on a medium by the recording unit 48 is exposed from the housing 20 when the main body 21 is disposed at the second open position. A portion of the conveyance path 49 is not exposed from the housing 20 when the main body 21 is disposed at the closed position and the first open position.

Figure 4:
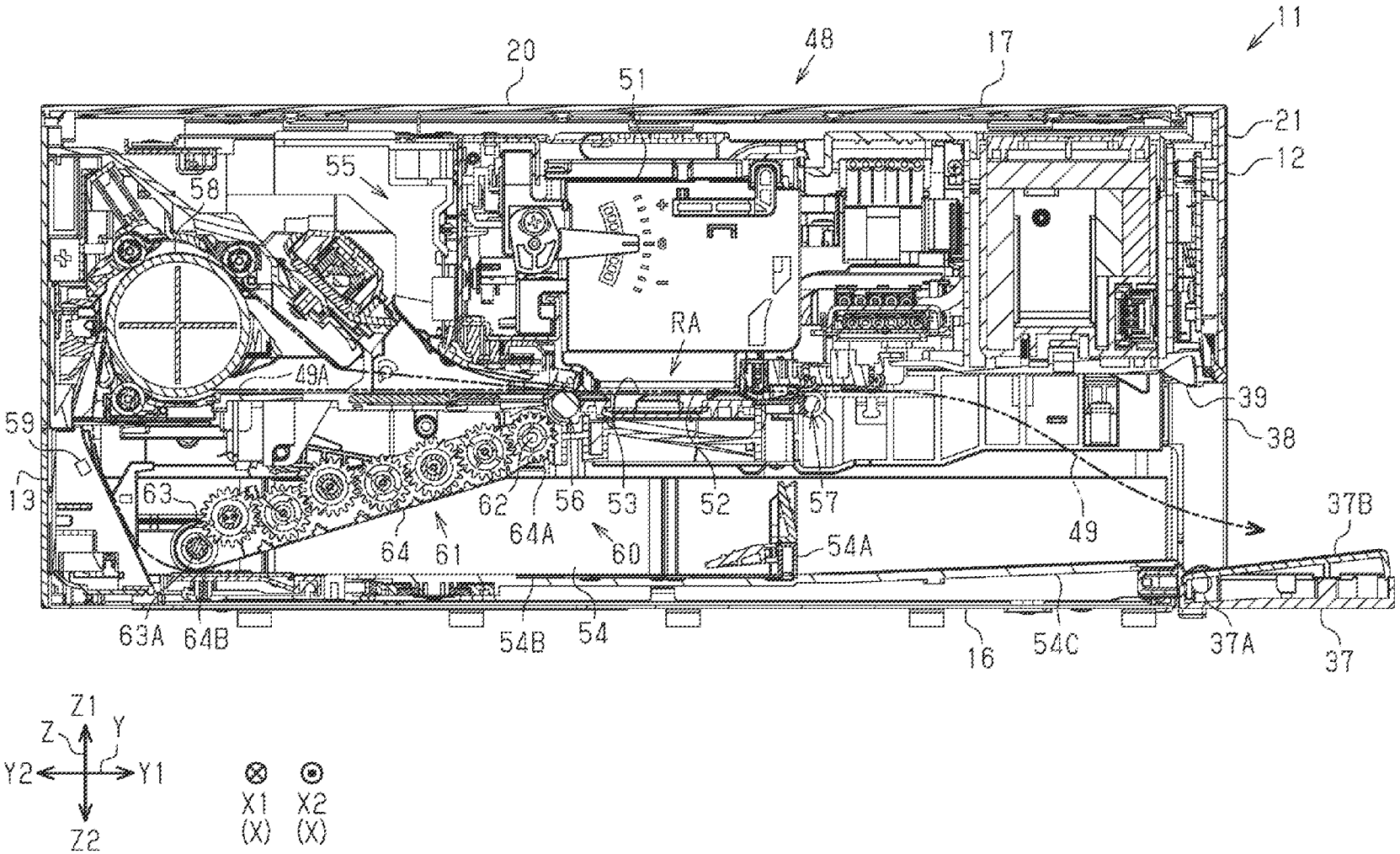
FIG. 4 is a cross-sectional view illustrating the recording device according to the first embodiment.

As illustrated in FIG. 4, the recording unit 48 includes a carriage 51 and a liquid ejection head 52. The carriage 51 supports the liquid ejection head 52 from the upper side Z1. The liquid ejection head 52 is provided on the lower side Z2 of the carriage 51. That is, the liquid ejection head 52 is mounted on the carriage 51.

The liquid ejection head 52 includes a plurality of nozzles which are not illustrated in the drawing. Each of the plurality of nozzles opens toward a medium supported by a support portion 53 to be described later. Each of the plurality of nozzles ejects liquid. The liquid ejection head 52 ejects liquid from the plurality of nozzles toward a medium supported by the support portion 53. In this manner, the recording unit 48 is configured to perform recording on a medium by ejecting liquid onto the medium. The liquid ejection head 52 is a serial head type that ejects liquid in association with the movement of the carriage 51 in the width direction X, but may be a line head type.

The recording device 11 includes the support portion 53. The support portion 53 is mounted on the main body 21. The support portion 53 is configured to support a medium. In particular, the support portion 53 supports a medium in the recording region RA in which recording is performed on a medium by the recording unit 48.

The recording device 11 includes a medium placement portion 54. One or a plurality of media can be placed on the medium placement portion 54. The medium placement portion 54 may be a tray on which a medium can be placed. The medium placement portion 54 is mounted on the main body 21. The medium placement portion 54 is displaceable from the main body 21 in the front-back direction Y. The medium placement portion 54 is pulled out from the main body 21 to the front side Y1 so that a medium can be mounted and removed. In this manner, the front side Y1 corresponds to an example of a pull-out direction in which the medium placement portion 54 is pulled out.

The medium placement portion 54 includes a partition plate 54A. The partition plate 54A is positioned at the center of the medium placement portion 54 in the front-back direction Y. The partition plate 54A partitions the medium placement portion 54 in the front-back direction Y. The medium placement portion 54 includes a first medium placement portion 54B. The medium placement portion 54 may include a second medium placement portion 54C. The first medium placement portion 54B and the second medium placement portion 54C are portions partitioned by the partition plate 54A in the front-back direction Y. The first medium placement portion 54B is positioned on the rear side Y2 from the second medium placement portion 54C. One or a plurality of media before reading can be placed on the first medium placement portion 54B. One or a plurality of media after reading can be placed on the second medium placement portion 54C.

The recording device 11 includes a medium feeding device 60. The medium feeding device 60 is positioned on the upper side Z1 of the medium placement portion 54 when the medium placement portion 54 is attached to the main body 21. Specifically, the medium feeding device 60 is positioned on the upper side Z1 of the first medium placement portion 54B when the medium placement portion 54 is attached to the main body 21. The medium feeding device 60 feeds media placed on the medium placement portion 54 one by one.

The recording device 11 includes a conveyance unit 55. The conveyance unit 55 is configured to convey a medium. The conveyance unit 55 is mounted on the main body 21. The conveyance unit 55 conveys a medium fed by the medium feeding device 60 along the conveyance path 49.

The conveyance unit 55 includes a plurality of rollers and a plurality of motors serving as driving sources. In particular, the conveyance unit 55 includes a conveyance roller pair 56. The conveyance roller pair 56 is positioned upstream of the conveyance path 49 of the support portion 53. The conveyance roller pair 56 conveys a medium to the support portion 53 along the conveyance path 49. Further, the conveyance unit 55 includes a discharge roller pair 57. The discharge roller pair 57 is positioned downstream of the conveyance path 49 of the support portion 53. The discharge roller pair 57 discharges a medium after recording along the conveyance path 49.

In this manner, a medium placed at the medium placement portion 54 is fed by the medium feeding device 60. The medium fed by the medium feeding device 60 is conveyed along the conveyance path 49 by the conveyance unit 55. Thereby, the recording unit 48 performs recording on the medium conveyed along the conveyance path 49 by the conveyance unit 55. That is, the recording unit 48 performs recording on the medium fed by the medium feeding device 60. In other words, the recording unit 48 performs recording on the medium fed by a feeding roller 63 to be described below.

The conveyance unit 55 includes a reversing unit 58. That is, the reversing unit 58 is mounted on the main body 21. The recording device 11 includes the reversing unit 58. The reversing unit 58 may be configured to be attachable to and detachable from the main body 21 from the rear side Y2. The reversing unit 58 includes a plurality of rollers. The reversing unit 58 is configured to convey a medium along the conveyance path 49.

The conveyance path 49 includes a reversing path 49A. The reversing path 49A is a path coupling the conveyance roller pair 56 and the reversing unit 58. The reversing path 49A extends along the front-back direction Y. After recording is performed on the front surface of a medium by the recording unit 48 in the recording region RA, the conveyance roller pair 56 conveys the medium to the reversing unit 58 along the reversing path 49A. The reversing unit 58 is configured to convey a medium along the conveyance path 49 in a state in which the medium conveyed along the reversing path 49A is reversed. That is, the reversing unit 58 reverses the medium fed by the medium feeding device 60.

As described above, the medium reversed by the reversing unit 58 is conveyed to the recording region RA again, and thus the recording unit 48 can perform recording on the back surface of the medium. Thereby, the recording unit 48 can perform printing on both sides of the medium. That is, the recording unit 48 can perform recording after the medium is reversed by the reversing unit 58. In particular, the recording unit 48 may be capable of recording on double-sided printable photographic paper as a medium.

The recording device 11 includes a medium detection unit 59. The medium detection unit 59 is provided along the conveyance path 49. The medium detection unit 59 may be provided between the medium placement portion 54 and the reversing unit 58 in the conveyance path 49, or may be provided between the reversing unit 58 and the conveyance roller pair 56. The medium detection unit 59 detects the tip end of a medium fed by the medium feeding device 60. Specifically, the medium detection unit 59 detects the tip end of the medium fed by a feeding roller 63 to be described later.

Configuration of Medium Feeding Device 60

Here, the medium feeding device 60 will be described in detail.

Figure 5:
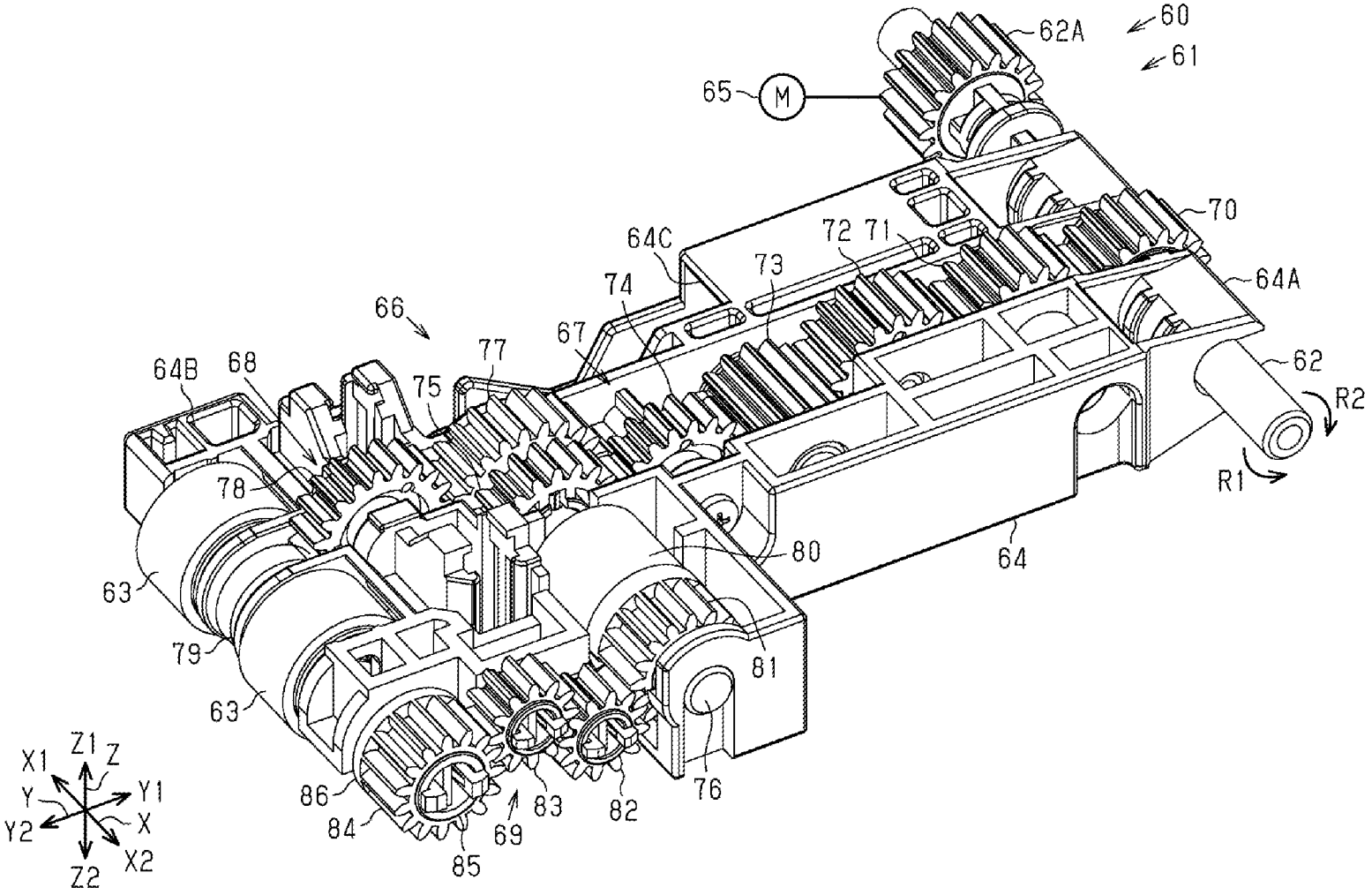
FIG. 5 is a diagram illustrating a medium feeding device according to the first embodiment.

As illustrated in FIGS. 4 and 5, the medium feeding device 60 includes a feeding roller unit 61 and a driving shaft 62. The feeding roller unit 61 is provided to be rotatable around the driving shaft 62. The driving shaft 62 extends in the width direction X. The driving shaft 62 may be a driving shaft for transmitting power to the feeding roller unit 61.

The feeding roller unit 61 includes a feeding roller 63. That is, the medium feeding device 60 includes the feeding roller 63. The feeding roller unit 61 may include a plurality of feeding rollers 63. The feeding roller unit 61 includes an arm portion 64. That is, the medium feeding device 60 includes the arm portion 64.

The feeding roller 63 is accommodated in the arm portion 64. The feeding roller 63 is provided at a tip end portion 64B of the arm portion 64. The feeding roller 63 is supported to be rotatable around a first rotation shaft 63A. The first rotation shaft 63A extends in the width direction X. The feeding roller 63 can feed a medium placed at the medium placement portion 54. A feeding direction in which the feeding roller 63 feeds a medium is a direction toward the rear side Y2. That is, the feeding direction in which the feeding roller 63 feeds a medium is a direction opposite to a pull-out direction in which the medium placement portion 54 is pulled out, but may not be a direction exactly opposite to the pull-out direction and may be a direction including a component in a direction opposite to the pull-out direction.

The arm portion 64 accommodates various members including the feeding roller 63. The arm portion 64 includes a base end portion 64A and a tip end portion 64B. The base end portion 64A may be positioned on the front side Y1 from the tip end portion 64B.

The arm portion 64 is provided to be rotatable around the driving shaft 62 at the base end portion 64A. That is, the arm portion 64 is rotatable around the driving shaft 62. The driving shaft 62 is configured to rotatably support the arm portion 64.

The arm portion 64 is attachable to and detachable from the driving shaft 62. Specifically, in a state in which the main body 21 is in a closed position and the medium placement portion 54 is removed from the main body 21, the arm portion 64 is exposed through the through hole 22A. In this manner, in a state in which the main body 21 is in a closed position and the medium placement portion 54 is removed from the main body 21, the arm portion 64 is attachable and detachable via the through hole 22A.

The arm portion 64 rotatably supports the feeding roller 63 at the tip end portion 64B. In particular, the arm portion 64 supports the feeding roller 63 in a swingable manner by providing a play between the arm portion 64 and the feeding roller 63. The arm portion 64 rotatably supports a displacement portion 86, which will be described later, at the tip end portion 64B.

The arm portion 64 moves the feeding roller 63 forward and backward with respect to a medium placed at the medium placement portion 54 by rotating around the driving shaft 62. The arm portion 64 can bring the feeding roller 63 into contact with the medium placed at the medium placement portion 54. An inclination angle of the arm portion 64 can be changed depending on the number of media placed on the medium placement portion 54. In this manner, the arm portion 64 is displaceable so as to change a distance between the feeding roller 63 and the medium placement portion 54 depending on the number of media placed on the medium placement portion 54.

As illustrated in FIG. 5, the arm portion 64 includes an engaged portion 64C. The engaged portion 64C is engageable with a second engaging portion 30F to be described later. The engaged portion 64C may be an engagement concave portion that opens toward the rear side Y2.

Figure 6:
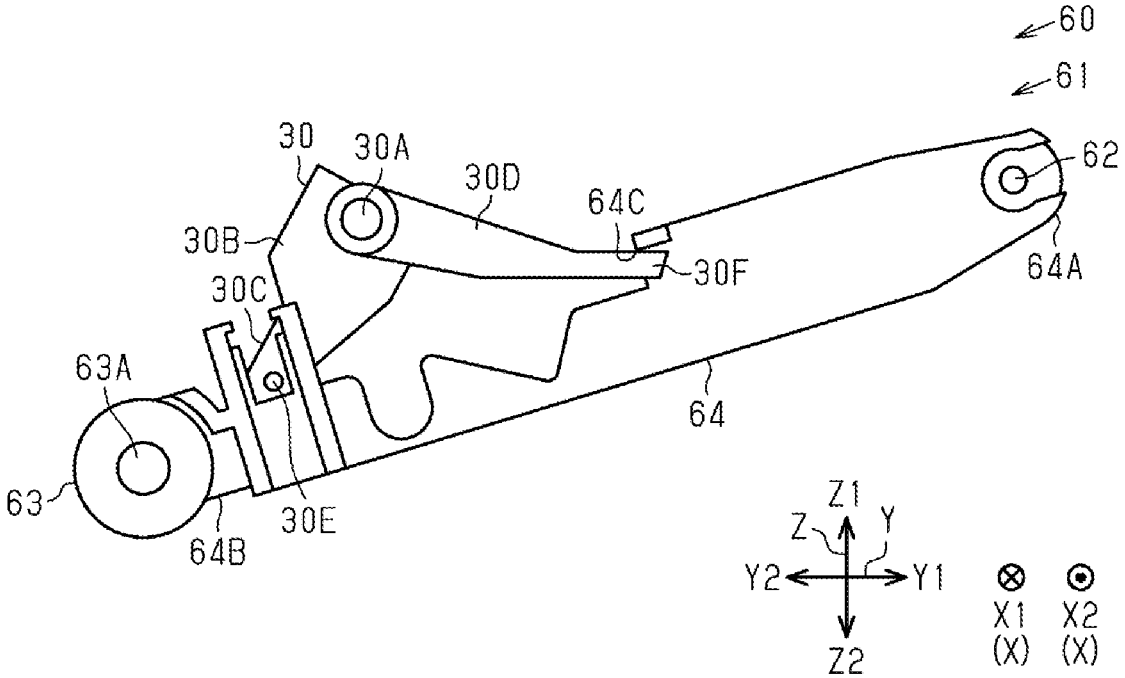
FIG. 6 is a schematic view illustrating the medium feeding device according to the first embodiment.
Figure 7:
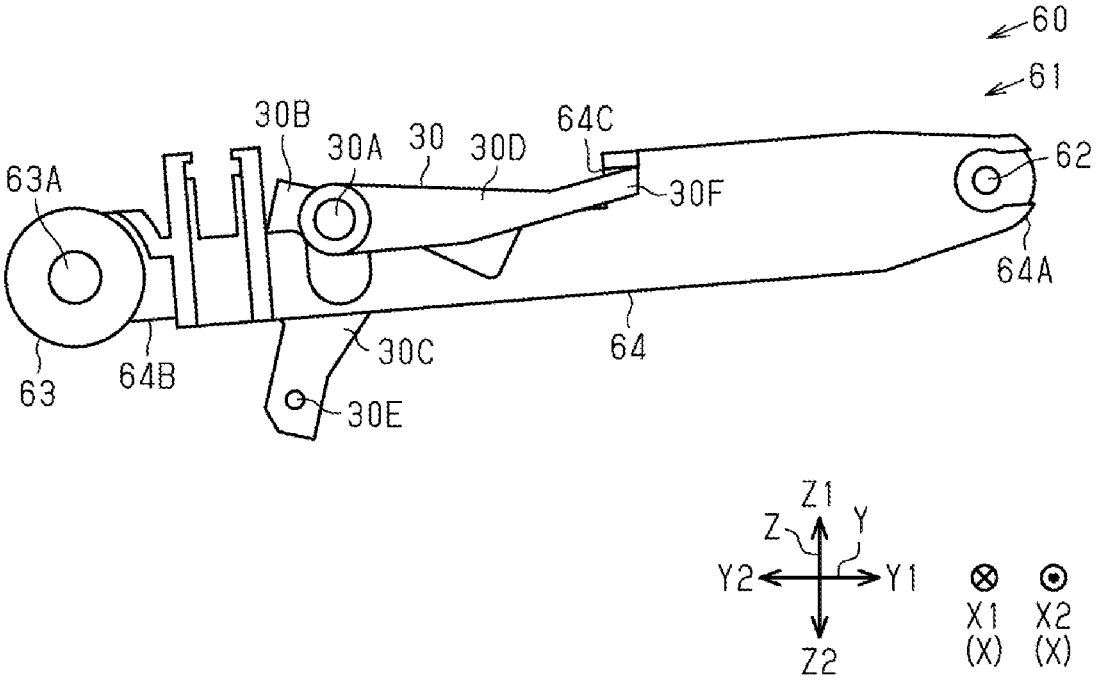
FIG. 7 is a schematic view illustrating the medium feeding device according to the first embodiment.

As illustrated in FIGS. 6 and 7, the arm portion 64 is displaceable between a feeding position and a retracted position by rotating around the driving shaft 62. As illustrated in FIG. 6, the feeding position is a position at which a medium placed at the medium placement portion 54 can be fed. As illustrated in FIG. 7, the retracted position is a position that does not interfere with the pull-out of the medium placement portion 54.

The recording device 11 includes an arm retracting portion 30. The arm retracting portion 30 is configured to retract the arm portion 64 to the retracted position when the medium placement portion 54 is pulled out in the pull-out direction. As illustrated in FIG. 7, the retracted position is a position that does not interfere with the pull-out of the medium placement portion 54.

The arm retracting portion 30 is provided in the main body 21. The arm retracting portion 30 has an L-shape when viewed in the width direction X. The arm retracting portion 30 is provided be rotatable around a shaft 30A. The shaft 30A extends in the width direction X.

The arm retracting portion 30 includes a main body portion 30B, a first lever 30C, and a second lever 30D. The first lever 30C protrudes from the main body portion 30B toward the lower side Z2. The second lever 30D protrudes from the main body portion 30B toward the front side Y1.

The arm retracting portion 30 includes a first engaging portion 30E and a second engaging portion 30F. The first engaging portion 30E is provided at a tip end portion of the first lever 30C. The first engaging portion 30E is engageable with a slide member which is not illustrated in the drawing. The first engaging portion 30E may be an engagement hole. The second engaging portion 30F is provided at a tip end portion of the second lever 30D. The second engaging portion 30F is engageable with the engaged portion 64C. The second engaging portion 30F may be an engagement convex portion.

A biasing force is applied to the arm retracting portion 30 toward the upper side Z1 by a biasing member which is not illustrated in the drawing. When no external force is applied, the arm portion 64 is positioned at the retracted position. The arm portion 64 may be displaced between the feeding position and the retracted position by a driving force of a motor which is not illustrated in the drawing. A biasing force may be applied to the arm portion 64 toward the lower side Z2 by a biasing member which is not illustrated in the drawing.

The slide member slides toward the rear side Y2 by the medium placement portion 54 being mounted on the rear side Y2. In this case, as illustrated in FIG. 6, the first engaging portion 30E also moves to the rear side Y2. Thereby, the arm retracting portion 30 rotates around the shaft 30A against the biasing force from the biasing member. Then, the arm retracting portion 30 displaces the arm portion 64 from the retracted position to the feeding position.

The slide member can slide toward the front side Y1 by the medium placement portion 54 being pulled out toward the front side Y1. In this manner, the slide member slides to the front side Y1, and thus the arm retracting portion 30 receives the biasing force applied from the biasing member and rotates around the shaft 30A as illustrated in FIG. 7. Then, the arm retracting portion 30 displaces the arm portion 64 from the feeding position to the retracted position.

As illustrated in FIG. 5, the medium feeding device 60 includes a driving unit 65. The driving unit 65 is a power source for the feeding roller unit 61. The driving unit 65 may be a motor. The driving unit 65 supplies power to the feeding roller unit 61 by rotating the driving shaft 62. Specifically, the driving unit 65 supplies power to the feeding roller unit 61 by rotating a gear 62A pivotally attached to the driving shaft 62. In particular, the driving unit 65 drives the feeding roller 63. The driving unit 65 drives a displacement portion 86 to be described later.

The driving unit 65 can perform forward rotation driving and reverse rotation driving. The forward rotation driving is driving capable of supplying forward rotation power to the feeding roller unit 61. The forward rotation power is power for causing the feeding roller 63 to perform forward rotation. The reverse rotation driving is driving capable of supplying reverse rotation power to the feeding roller unit 61. The reverse rotation power is power acting in a direction opposite to the forward rotation power. The driving shaft 62 is rotatable in a first rotation direction R1 when the forward rotation power of the driving unit 65 is transmitted thereto. The driving shaft 62 is rotatable in a second rotation direction R2 when the reverse rotation power of the driving unit 65 is transmitted thereto.

Configuration of Power Transmission Unit 66

The feeding roller unit 61 includes a power transmission unit 66. That is, the medium feeding device 60 includes the power transmission unit 66. The power transmission unit 66 is accommodated in the arm portion 64. The power transmission unit 66 can transmit power, which is supplied from the driving unit 65, to the feeding roller 63. The power transmission unit 66 can transmit power, which is supplied from the driving unit 65, to the displacement portion 86 to be described later.

The power transmission unit 66 includes a common power transmission unit 67. The power transmission unit 66 includes a first power transmission unit 68 and a second power transmission unit 69. The common power transmission unit 67 is a transmission unit used as a common transmission path. The common transmission path is a transmission path common to both a first transmission path and a second transmission path. The first transmission path is a transmission path for transmitting power, which is supplied from the driving unit 65, to the feeding roller 63. The second transmission path is a transmission path for transmitting power, which is supplied from the driving unit 65, to the displacement portion 86. That is, the first transmission path includes the common power transmission unit 67 and the first power transmission unit 68. The second transmission path includes the common power transmission unit 67 and the second power transmission unit 69.

The common power transmission unit 67 is a transmission unit to which power supplied from the driving unit 65 is transmitted by the rotation of the driving shaft 62. The common power transmission unit 67 transmits power supplied from the driving unit 65 to both the first power transmission unit 68 and the second power transmission unit 69. That is, the common power transmission unit 67 can transmit power supplied from the driving unit 65 to both the feeding roller 63 and the displacement portion 86.

The common power transmission unit 67 includes a plurality of gears 70 to 75. The common power transmission unit 67 includes a common rotation shaft 76. Each of the plurality of gears 70 to 75 is pivotally attached to the arm portion 64 so as to be rotatable around a shaft extending in the width direction X. The plurality of gears 70 to 75 engage with each other in order.

Each of the gears 70, 72, and 74 rotates in the first rotation direction R1 when forward rotation power of the driving unit 65 is transmitted. Each of the gears 71, 73, and 75 rotates in the second rotation direction R2 when forward rotation power of the driving unit 65 is transmitted. Each of the gears 70, 72, and 74 rotates in the second rotation direction R2 when reverse rotation power of the driving unit 65 is transmitted. Each of the gears 71, 73, and 75 rotates in the first rotation direction R1 when reverse rotation power of the driving unit 65 is transmitted.

In particular, the gear 70 is provided on the most upstream in the power path of the common power transmission unit 67 among the plurality of gears 70 to 75. The gear 70 is pivotally attached to the driving shaft 62. In this manner, the gear 70 is a member to which power supplied from the driving unit 65 is transmitted by the rotation of the driving shaft 62.

The gear 75 is provided on the most downstream in the power path of the common power transmission unit 67 among the plurality of gears 70 to 75. The gear 75 is attached to the common rotation shaft 76. The gear 75 rotates the common rotation shaft 76 by rotation. The gear 75 transmits power supplied from the driving unit 65 to both the first power transmission unit 68 and the second power transmission unit 69. That is, the gear 75 branches power supplied from the driving unit 65 to the first power transmission unit 68 and the second power transmission unit 69.

In this manner, the gear 75 transmits forward rotation power of the driving unit 65 to both the first power transmission unit 68 and the second power transmission unit 69 as power in the second rotation direction R2. The gear 75 transmits reverse rotation power of the driving unit 65 to both the first power transmission unit 68 and the second power transmission unit 69 as power in the first rotation direction R1. Specifically, the gear 75 rotates in the same direction as the rotation direction of the feeding roller 63 when a medium placed at the medium placement portion 54 is fed by the feeding roller 63. The gear 75 corresponds to an example of a first gear.

The first power transmission unit 68 is a transmission unit used as a first transmission path. The first power transmission unit 68 is a transmission unit to which power supplied from the driving unit 65 is transmitted by rotation of the common rotation shaft 76. The first power transmission unit 68 transmits power, which is supplied from the driving unit 65, to the feeding roller 63. That is, the first power transmission unit 68 can transmit power, which is supplied from the driving unit 65, to the feeding roller 63.

The first power transmission unit 68 includes a plurality of gears 77 to 79. That is, the power transmission unit 66 includes the plurality of gears 77 to 79. The first power transmission unit 68 includes the first rotation shaft 63A. Each of the plurality of gears 77 to 79 is pivotally attached to the arm portion 64 so as to be rotatable around a shaft extending in the width direction X. The plurality of gears 77 to 79 engage with each other in order.

In particular, the gear 77 is provided on the most upstream in the power path of the first power transmission unit 68 among the plurality of gears 77 to 79. The gear 77 is pivotally attached to the common rotation shaft 76. In this manner, the gear 77 is a member to which power supplied from the driving unit 65 is transmitted by the rotation of the common rotation shaft 76.

The gear 77 includes a one-way clutch. The gear 77 itself may be a one-way clutch, or the gear 77 may be combined with a one-way clutch. That is, the first power transmission unit 68 includes a one-way clutch. The gear 77 is pivotally attached to the common rotation shaft 76. When the common rotation shaft 76 rotates in the second rotation direction R2, the gear 77 rotates together with the common rotation shaft 76 in the second rotation direction R2. When the common rotation shaft 76 rotates in the first rotation direction R1, the gear 77 idles and does not rotate.

The gear 79 is provided on the most downstream in the power path of the first power transmission unit 68 among the plurality of gears 77 to 79. The gear 79 is pivotally attached to the first rotation shaft 63A. The gear 79 rotates the first rotation shaft 63A by rotation. The gear 79 transmits power, which is supplied from the driving unit 65, to the first rotation shaft 63A. That is, the gear 79 transmits power, which is supplied from the driving unit 65, to the feeding roller 63.

Each of the gears 77 and 79 rotates in the second rotation direction R2 when forward rotation power of the driving unit 65 is transmitted. The gear 78 rotates in the first rotation direction R1 when forward rotation power of the driving unit 65 is transmitted. Reverse rotation power of the driving unit 65 is not transmitted to the gear 77, and the gear 77 does not rotate. For this reason, the reverse rotation power of the driving unit 65 is not transmitted to each of the gears 77 to 79.

In this manner, the feeding roller 63 can feed a medium placed at the medium placement portion 54 by rotating in a state of being in contact with the medium placed at the medium placement portion 54. In particular, the feeding roller 63 can feed media placed on the medium placement portion 54 one by one. A feeding direction in which the feeding roller 63 feeds the media may be a direction toward the rear side Y2. That is, the feeding direction in which the feeding roller 63 feeds the medium may be a direction opposite to a pull-out direction.

In particular, the gear 77 transmits forward rotation power, which is supplied from the driving unit 65, to the feeding roller 63, but does not transmit reverse rotation power, which is supplied from the driving unit 65, to the feeding roller 63. Thereby, the feeding roller 63 feeds a medium placed at the medium placement portion 54 by the forward rotation power supplied from the driving unit 65. On the other hand, the reverse rotation power which is supplied from the driving unit 65 is not transmitted to the downstream from the gear 77, and thus is not transmitted to the feeding roller 63. In this manner, the second rotation direction R2 is the feeding direction of the feeding roller 63.

The second power transmission unit 69 is a transmission path used as a second transmission path. The second power transmission unit 69 is a transmission unit to which power, which is supplied from the driving unit 65, is transmitted by the rotation of the common rotation shaft 76. The second power transmission unit 69 transmits power, which is supplied from the driving unit 65, to the displacement portion 86. That is, the second power transmission unit 69 can transmit power, which is supplied from the driving unit 65, to the displacement portion 86.

The second power transmission unit 69 includes a torque limiter 80. That is, the power transmission unit 66 includes the torque limiter 80. The torque limiter 80 is provided on the most upstream in the power path of the second power transmission unit 69. The torque limiter 80 is pivotally attached to the common rotation shaft 76. In this manner, the torque limiter 80 is a member to which power, which is supplied from the driving unit 65, is transmitted by the rotation of the common rotation shaft 76. That is, the torque limiter 80 is provided coaxially with the gear 75.

The torque limiter 80 is configured to interrupt transmission of power by a predetermined load. For this reason, when the predetermined load is not applied, the torque limiter 80 rotates together with the common rotation shaft 76 when the common rotation shaft 76 rotates. When a load equal to or greater than the predetermined load is applied, the torque limiter 80 idles and does not rotate even when the common rotation shaft 76 rotates.

The second power transmission unit 69 includes a plurality of gears 81 to 84. The second power transmission unit 69 includes a second rotation shaft 85. Each of the plurality of gears 81 to 84 is pivotally attached to the arm portion 64 so as to be rotatable around a shaft extending in the width direction X. The plurality of gears 81 to 84 engage with each other in order.

In particular, the gear 81 is coupled to the torque limiter 80. For this reason, when the torque limiter 80 rotates, the gear 81 rotates together with the torque limiter 80. That is, the gear 81 rotates when a predetermined load is not applied to the torque limiter 80, but does not rotate when a load equal to or greater than the predetermined load is applied to the torque limiter 80.

The gear 84 is provided on the most downstream in the power path of the second power transmission unit 69 among the plurality of gears 81 to 84. The gear 84 is pivotally attached to the second rotation shaft 85. The gear 84 transmits power, which is supplied from the driving unit 65, to the second rotation shaft 85. That is, the gear 84 transmits power, which is supplied from the driving unit 65, to the displacement portion 86 pivotally attached to the second rotation shaft 85.

When a predetermined load is not applied to the torque limiter 80, each of the gears 81 and 83 rotates in the second rotation direction R2 when forward rotation power of the driving unit 65 is transmitted. When a predetermined load is not applied to the torque limiter 80, each of the gears 82 and 84 rotates in the first rotation direction R1 when forward rotation power of the driving unit 65 is transmitted. When a predetermined load is not applied to the torque limiter 80, each of the gears 81 and 83 rotates in the first rotation direction R1 when reverse rotation power of the driving unit 65 is transmitted. When a predetermined load is not applied to the torque limiter 80, each of the gears 82 and 84 rotates in the second rotation direction R2 when reverse rotation power of the driving unit 65 is transmitted. Each of the gears 81 to 84 does not rotate when a load equal to or greater than a predetermined load is applied to the torque limiter 80.

In this manner, the torque limiter 80 transmits power, which is supplied from the driving unit 65, to the displacement portion 86 when a predetermined load is not applied, but does not transmit power, which is supplied from the driving unit 65, to the displacement portion 86 when a load equal to or greater than the predetermined load is applied.

Configuration of Displacement Portion 86

Figure 8:
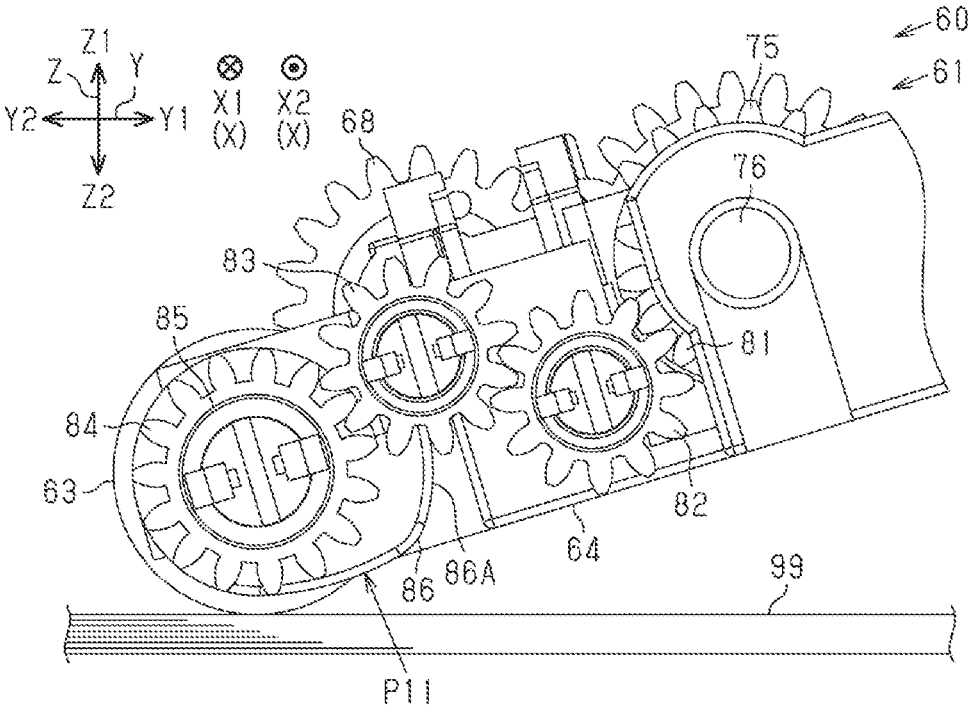
FIG. 8 is a side view illustrating the medium feeding device according to the first embodiment.

As illustrated in FIGS. 5 and 8, the medium feeding device 60 includes the displacement portion 86. The displacement portion 86 is accommodated in the arm portion 64. The displacement portion 86 is provided at the tip end portion 64B of the arm portion 64. The displacement portion 86 is coupled to the gear 84. The displacement portion 86 is provided in the first width direction X1 from the gear 84. The displacement portion 86 is rotatable around the second rotation shaft 85. The second rotation shaft 85 may be positioned coaxially with the first rotation shaft 63A. That is, the rotation shaft of the displacement portion 86 is positioned coaxially with the rotation shaft of the feeding roller 63.

The displacement portion 86 is a cam. The displacement portion 86 includes a cam portion 86A. The cam portion 86A is a portion of the displacement portion 86 which protrudes in the outer circumferential direction. The gear 84 and the displacement portion 86 may be an integrally formed cam gear.

The displacement portion 86 is displaceable between a first position P11 and a second position P12. In particular, the displacement portion 86 is displaceable between the first position P11 and the second position P12 by rotation. The displacement portion 86 is displaceable between the first position P11 and the second position P12 with power supplied from the driving unit 65.

Figure 9:
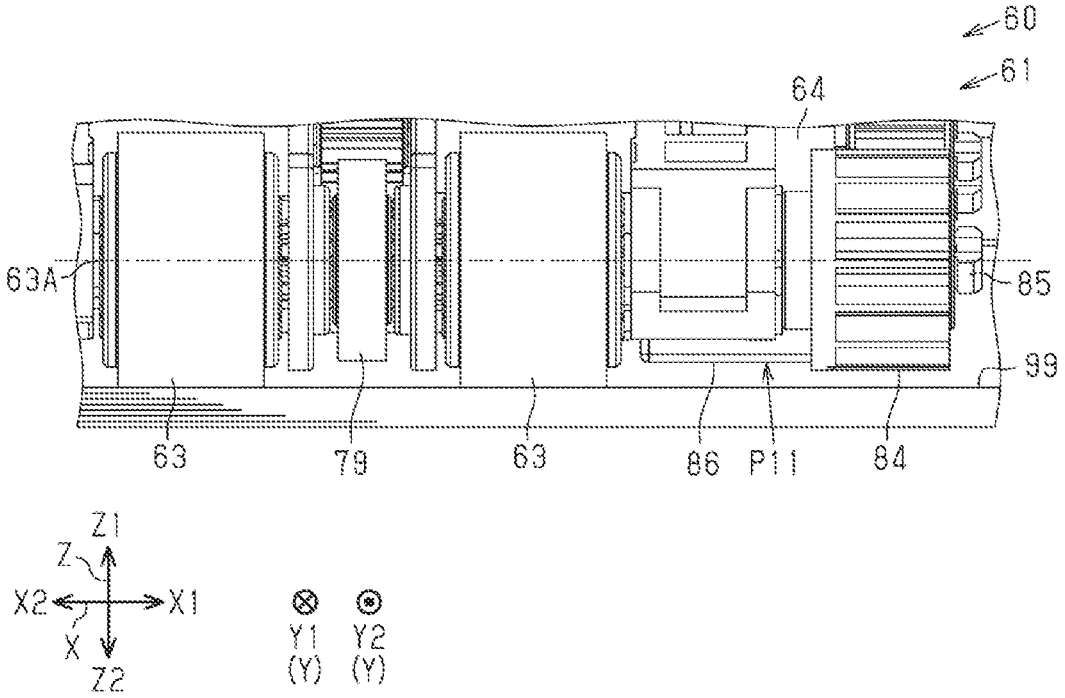
FIG. 9 is a rear view illustrating the medium feeding device according to the first embodiment.

As illustrated in FIGS. 8 and 9, the first position P11 is a position at which the cam portion 86A does not protrude further than the feeding roller 63. That is, the first position P11 is a position at which the feeding roller 63 is displaced to an abutting position.

The abutting position is included in a feeding position. The abutting position is a position at which the cam portion 86A does not face a medium placed at the medium placement portion 54, and thus the feeding roller 63 protrudes further than the displacement portion 86 with respect to the medium placed at the medium placement portion 54. That is, the abutting position is a position at which the feeding roller 63 abuts on the medium placed at the medium placement portion 54. In the drawing, the photographic paper 99 is adopted as an example of a medium.

The displacement portion 86 rotates from the second position P12 to the first position P11 by forward rotation power supplied from the driving unit 65. That is, the displacement portion 86 displaces the feeding roller 63 to the abutting position by the forward rotation power supplied from the driving unit 65.

Figure 10:
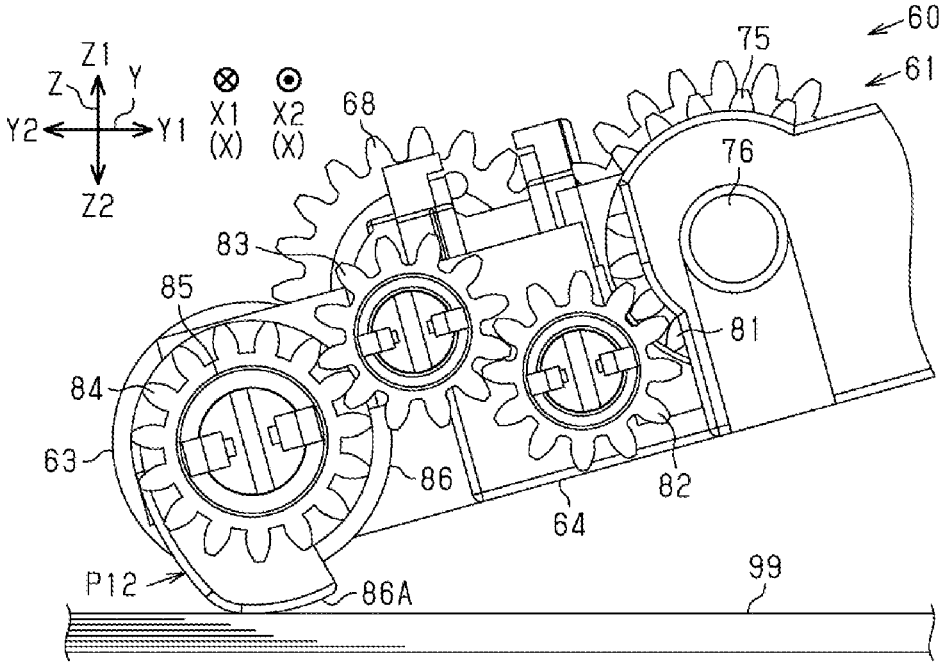
FIG. 10 is a side view illustrating the medium feeding device according to the first embodiment.
Figure 11:
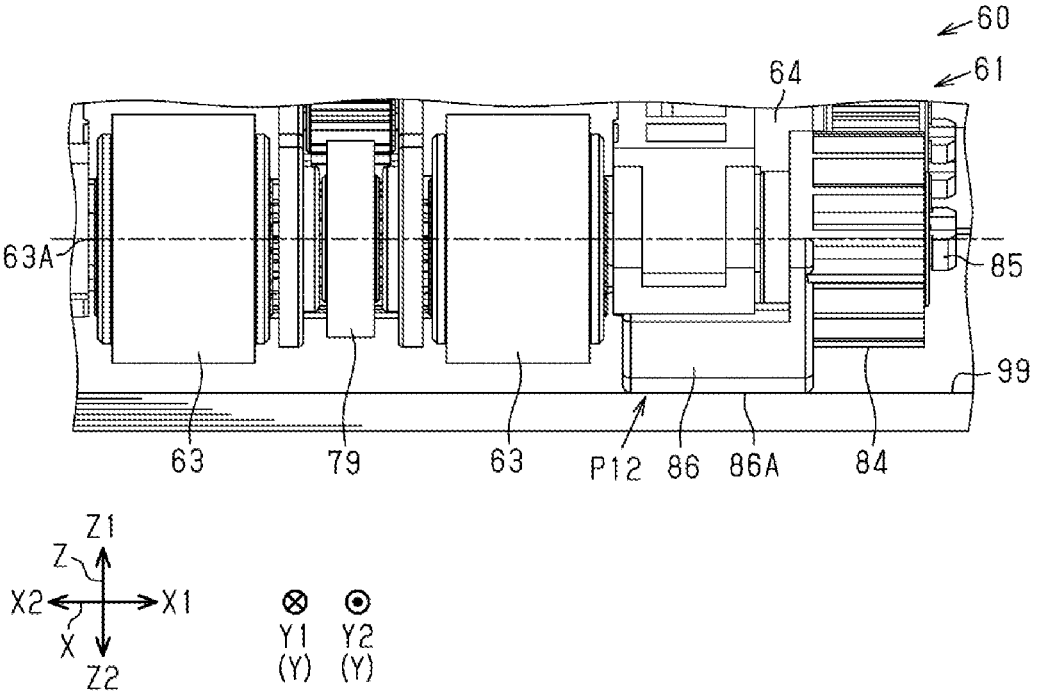
FIG. 11 is a rear view illustrating the medium feeding device according to the first embodiment.

As illustrated in FIGS. 10 and 11, the second position P12 is a position at which the cam portion 86A protrudes further than the feeding roller 63. That is, the second position P12 is a position at which the feeding roller 63 is displaced to a separation position.

The separation position is included in a feeding position. The separation position is a position at which the displacement portion 86 protrudes further than the feeding roller 63 with respect to the medium placed at the medium placement portion 54 due to the cam portion 86A moving toward the medium placed at the medium placement portion 54. That is, the separation position is a position at which the feeding roller 63 is separated from the medium placed at the medium placement portion 54.

The displacement portion 86 rotates from the first position P11 to the second position P12 by reverse rotation power supplied from the driving unit 65. That is, the displacement portion 86 displaces the feeding roller 63 to the separation position by the reverse rotation power supplied from the driving unit 65.

In this manner, the displacement portion 86 is displaced between the first position P11 and the second position P12 to thereby displace the feeding roller 63 between the abutting position and the separation position. The normal direction of the displacement portion 86 when the displacement portion 86 is displaced from the second position P12 to the first position P11 is a direction toward the front side Y1. That is, the direction in which the displacement portion 86 is displaced from the second position P12 to the first position P11 is the same direction as a direction along the pull-out direction in which the medium placement portion 54 is pulled out, but may not be exactly the same direction as the direction along the pull-out direction or may be a direction including a component in the same direction as the direction along the pull-out direction.

The normal direction of the displacement portion 86 when the displacement portion 86 is displaced from the first position P11 to the second position P12 is the rear side Y2. The rotation direction of the displacement portion 86 when the displacement portion 86 is displaced from the first position P11 to the second position P12 is the same as the rotation direction according to the reverse rotation power supplied from the driving unit 65. That is, the direction in which the displacement portion 86 is displaced from the first position P11 to the second position P12 is the same as the rotation direction by the reverse rotation power supplied from the driving unit 65.

Configuration of Regulating Portion 87

Figure 12:
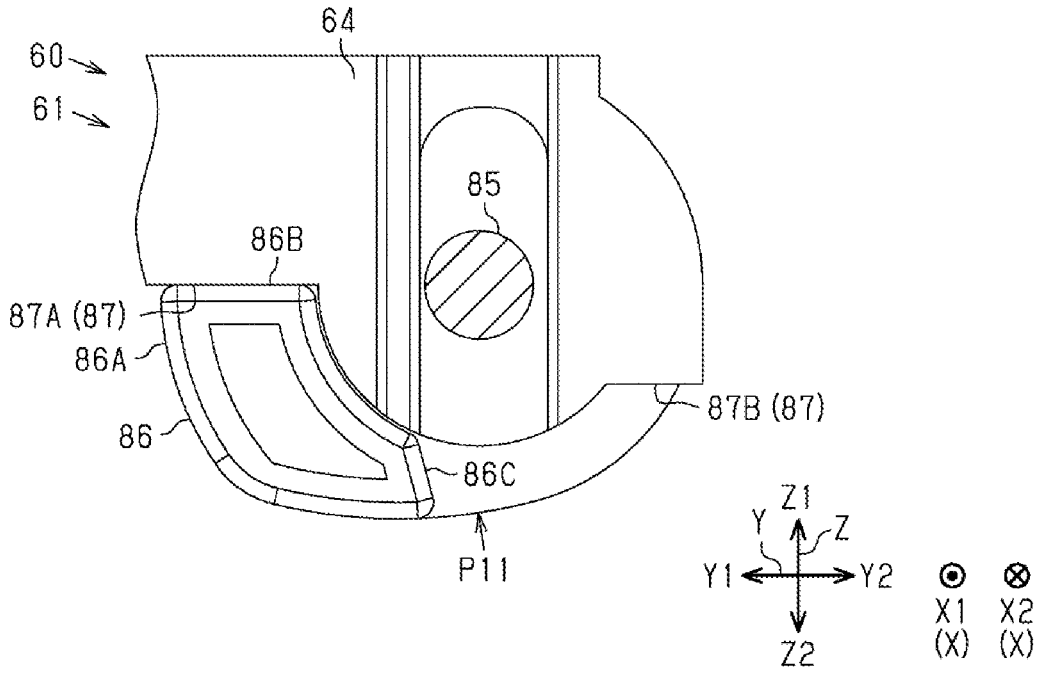
FIG. 12 is a side view illustrating the medium feeding device according to the first embodiment.
Figure 13:
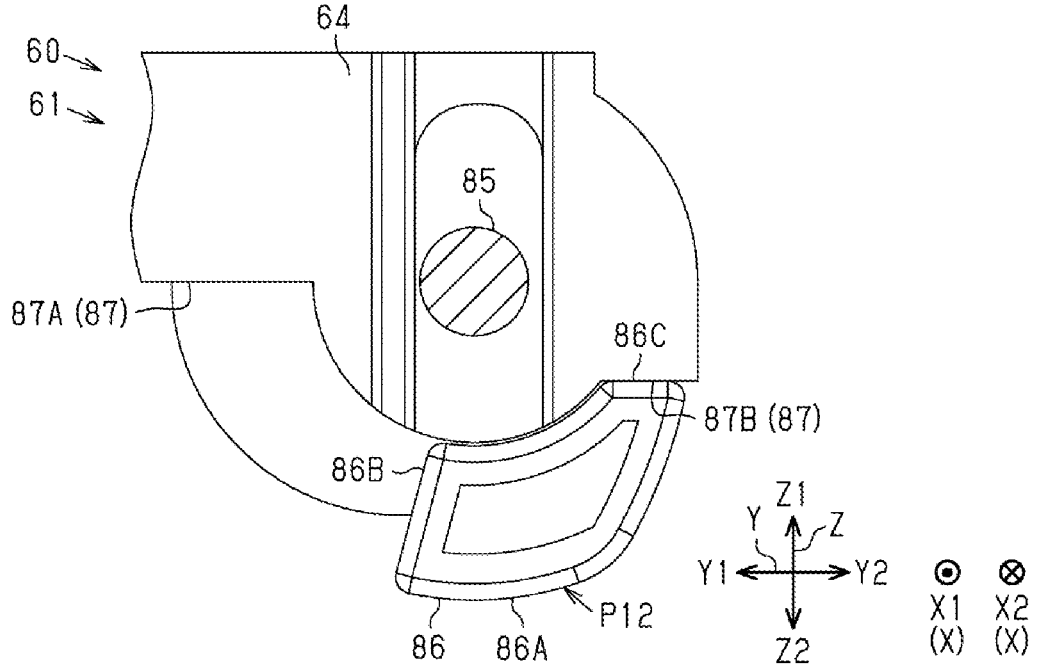
FIG. 13 is a side view illustrating the medium feeding device according to the first embodiment.

As illustrated in FIGS. 12 and 13, the medium feeding device 60 includes a regulating portion 87. Specifically, the feeding roller unit 61 includes the regulating portion 87. The regulating portion 87 may be provided in the arm portion 64. The regulating portion 87 regulates the displacement of the displacement portion 86.

As illustrated in FIG. 12, the regulating portion 87 may include a first regulating portion 87A. When the displacement portion 86 is in the first position P11, the first regulating portion 87A abuts on a first abutting surface 86B provided in the displacement portion 86. The first abutting surface 86B may be provided on a side of the displacement portion 86 in the first width direction X1 so as to face the first regulating portion 87A when the displacement portion 86 is located at the first position P11. In this manner, when the displacement portion 86 is displaced from the second position P12 to the first position P11, the first regulating portion 87A regulates displacement of the displacement portion 86 at the first position P11. In such a case, when the displacement of the displacement portion 86 is regulated by the first regulating portion 87A at the first position P11, the torque limiter 80 interrupts the transmission of power to the displacement portion 86 by a predetermined load.

As illustrated in FIG. 13, the regulating portion 87 may include a second regulating portion 87B. When the displacement portion 86 is located at the second position P12, the second regulating portion 87B abuts on a second abutting surface 86C provided in the displacement portion 86. The second abutting surface 86C may be provided on a side of the displacement portion 86 in the first width direction X1 so as to face the second regulating portion 87B when the displacement portion 86 is located at the second position P12. In this manner, when the displacement portion 86 is displaced from the first position P11 to the second position P12, the second regulating portion 87B regulates the displacement of the displacement portion 86 at the second position P12. In such a case, when the displacement of the displacement portion 86 is regulated by the second regulating portion 87B at the second position P12, the torque limiter 80 interrupts the transmission of power to the displacement portion 86 by a predetermined load.

Abutting Processing

Here, abutting processing will be described with reference to FIG. 14. The abutting processing is processing executed by the control unit 23 at a predetermined cycle.

Figure 14:
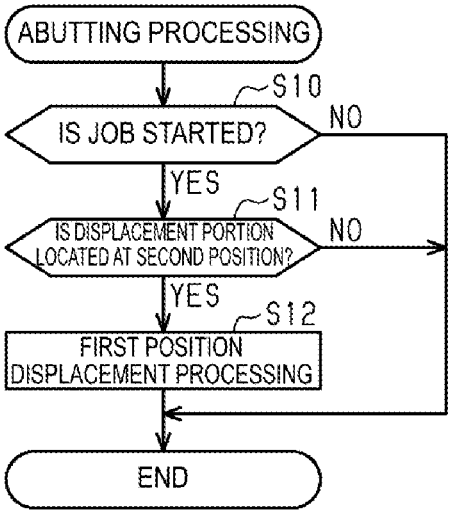
FIG. 14 is a flowchart illustrating processing according to the first embodiment.

As illustrated in FIG. 14, in step S10, the control unit 23 determines whether a job is started based on a user's instruction. The job is processing for performing recording on a medium. The job may be processing for performing recording on one or a plurality of media. When the control unit 23 determines that the job is not started, the control unit 23 does not execute steps S11 and S12 and terminates the abutting processing. When the control unit 23 determines that the job is started, the control unit 23 causes the processing to proceed to step S11.

In step S11, the control unit 23 determines whether the displacement portion 86 is located at the second position P12. That is, the control unit 23 determines whether the feeding roller 63 is located at the separation position. The control unit 23 determines whether the displacement portion 86 is located at the second position P12 based on positional information assigned to the memory. The positional information is information indicating the position of the displacement portion 86. The positional information is stored in the memory by the control unit 23 in association with the displacement of the displacement portion 86. When the control unit 23 determines that the displacement portion 86 is not located at the second position P12, the control unit 23 does not execute step S12 and terminates the abutting processing. That is, when the control unit 23 determines that the displacement portion 86 is located at the first position P11, the control unit 23 does not execute step S12 and terminates the abutting processing. When the control unit 23 determines that the displacement portion 86 is located at the second position P12, the control unit 23 causes the processing to proceed to step S12.

In step S12, the control unit 23 executes first position displacement processing. In the first position displacement processing, the control unit 23 causes the driving unit 65 to perform forward rotation driving. Thereby, the displacement portion 86 is displaced from the second position P12 to the first position P11. The feeding roller 63 is displaced from the separation position to the abutting position. In this manner, the control unit 23 displaces the displacement portion 86 to the second position P12 when the job of performing recording on a medium is started. The control unit 23 stores the positional information indicating the first position P11 in the memory. When the first position displacement processing is terminated, the control unit 23 terminates the abutting processing.

After the abutting processing is terminated, the control unit 23 continuously causes the driving unit 65 to perform forward rotation driving to thereby execute feeding processing. For this reason, a period of time until the feeding processing is executed is different between when the displacement portion 86 is located at the first position P11 and when the displacement portion 86 is displaced from the second position P12 to the first position P11. Specifically, a period of time until the feeding processing is executed is longer when the displacement portion 86 is displaced from the second position P12 to the first position P11 than when the displacement portion 86 is located at the first position P11. The abutting processing and the feeding processing are not clearly distinguished from each other at the time of control and may be continuously executed as one processing.

First Separation Processing

Next, first separation processing will be described with reference to FIG. 15. The first separation processing is processing executed by the control unit 23 at a predetermined cycle.

Figure 15:
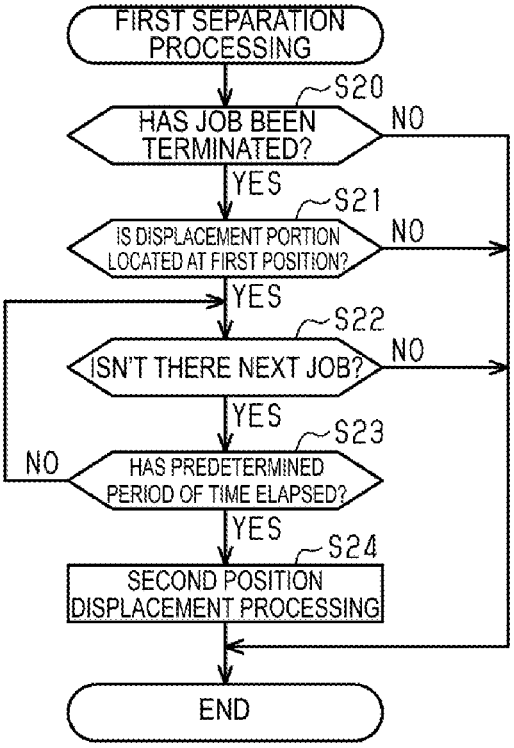
FIG. 15 is a flowchart illustrating first separation processing according to the first embodiment.

As illustrated in FIG. 15, in step S20, the control unit 23 determines whether a job has been terminated. When the control unit 23 determines that the job has not been terminated, the control unit 23 does not execute steps S21 to S24 and terminates the first separation processing. When the control unit 23 determines that the job has been terminated, the control unit 23 causes the processing to proceed to step S21.

In step S21, the control unit 23 determines whether the displacement portion 86 is located at the first position P11. That is, the control unit 23 determines whether the feeding roller 63 is located at the abutting position. The control unit 23 determines whether the displacement portion 86 is located at the first position P11 based on positional information assigned to the memory. When the control unit 23 determines that the displacement portion 86 is not located at the first position P11, the control unit 23 does not execute steps S22 to S24 and terminates the first separation processing. That is, when the control unit 23 determines that the displacement portion 86 is located at the second position P12, the control unit 23 does not execute steps S22 to S24 and terminates the first separation processing. When the control unit 23 determines that the displacement portion 86 is located at the first position P11, the control unit 23 causes the processing to proceed to step S22.

In step S22, the control unit 23 determines whether there is a next job. That is, the control unit 23 determines whether there is a next job after the termination of the job. When the control unit 23 determines that there is a next job, the control unit 23 does not execute steps S23 and S24 and terminates the first separation processing. When the control unit 23 determines that there is no next job, the control unit 23 causes the processing to proceed to step S23.

In step S23, the control unit 23 determines whether a predetermined period of time has elapsed. The control unit 23 measures a period of time that has elapsed since it is determined that the job has been terminated. The control unit 23 determines whether the predetermined period of time has elapsed based on whether a period of time that has elapsed since it is determined that the job has been terminated has reached the predetermined period of time. When the control unit 23 determines that the predetermined period of time has not elapsed, the control unit 23 causes the processing to proceed to step S22 again. When the control unit 23 determines that the predetermined period of time has elapsed, the control unit 23 causes the processing to proceed to step S24. In this manner, when the control unit 23 determines that there is a next job before the predetermined period of time elapses after the termination of the job, the control unit 23 does not execute step S24 and terminates the first separation processing. When the control unit 23 determines that there is no next job for a predetermined period of time after the termination of the job, the control unit 23 causes the processing to proceed to step S24.

In step S24, the control unit 23 executes second position displacement processing. In the second position displacement processing, the control unit 23 causes the driving unit 65 to perform reverse rotation driving. Thereby, the displacement portion 86 is displaced from the first position P11 to the second position P12. In this manner, the control unit 23 displaces the displacement portion 86 to the second position P12 when there is no next job for a predetermined period of time after the termination of the job for performing recording on a medium. The feeding roller 63 is displaced from the abutting position to the separation position. Then, the control unit 23 stores positional information indicating the second position P12 in the memory. When the second position displacement processing is terminated, the control unit 23 terminates the first separation processing.

Second Separation Processing

Next, second separation processing will be described with reference to FIG. 16. The second separation processing is processing executed by the control unit 23 at a predetermined cycle.

Figure 16:
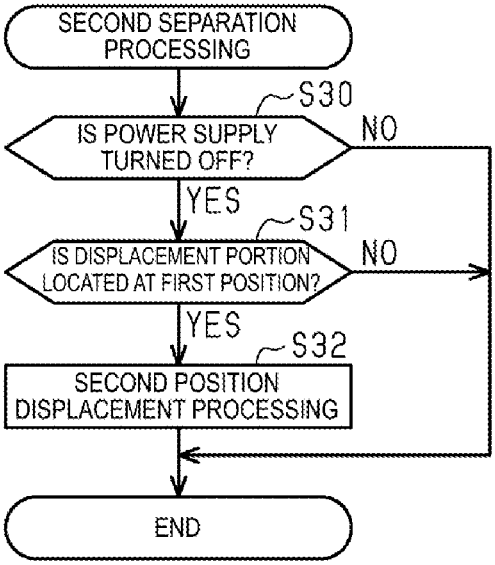
FIG. 16 is a flowchart illustrating second separation processing according to the first embodiment.

As illustrated in FIG. 16, in step S30, the control unit 23 determines whether power is to be shut off. The shut-off of power may be performed by a user's instruction or may be performed by power-off. In this case, the second separation processing may be executed based on a backup power supply. When the control unit 23 determines that power is not shut off, the control unit 23 terminates the second separation processing without executing steps S31 and S32. When the control unit 23 determines that power is to be shut off, the control unit 23 causes the processing to proceed to step S31.

In step S31, the control unit 23 determines whether the displacement portion 86 is located at the first position P11, similar to step S21. When the control unit 23 determines that the displacement portion 86 is not located at the first position P11, the control unit 23 does not execute step S32 and terminates the second separation processing. That is, when the control unit 23 determines that the displacement portion 86 is located at the second position P12, the control unit 23 does not execute step S32 and terminates the second separation processing. When the control unit 23 determines that the displacement portion 86 is located at the first position P11, the control unit 23 causes the processing to proceed to step S32.

In step S32, the control unit 23 executes the second position displacement processing in the same manner as in step S24. In the second position displacement processing, the control unit 23 causes the driving unit 65 to perform reverse rotation driving. Thereby, the displacement portion 86 is displaced from the first position P11 to the second position P12. In this manner, the control unit 23 displaces the displacement portion 86 to the second position P12 when power is shut off. The feeding roller 63 is displaced from the abutting position to the separation position. Then, the control unit 23 stores positional information indicating the second position P12 in the memory. When the second position displacement processing is terminated, the control unit 23 terminates the second separation processing.

Medium Feeding Monitoring Processing

Next, medium feeding monitoring processing will be described with reference to FIG. 17. The medium feeding monitoring processing is processing executed by the control unit 23 at a predetermined cycle.

Figure 17:
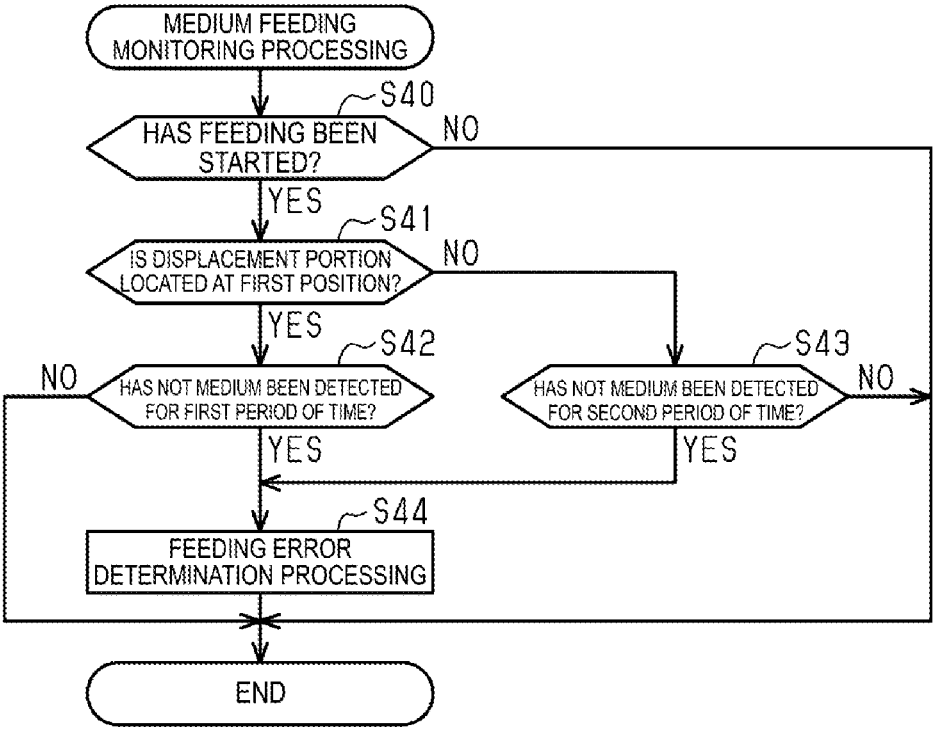
FIG. 17 is a flowchart illustrating medium feeding monitoring processing according to the first embodiment.

As illustrated in FIG. 17, in step S40, the control unit 23 determines whether feeding of a medium is started by the feeding roller 63. When the control unit 23 determines that the feeding of the medium is not started, the control unit 23 does not execute steps S41 to S44 and terminates the medium feeding monitoring processing. When the control unit 23 determines that the feeding of the medium is started, the control unit 23 causes the processing to proceed to step S41.

In step S41, the control unit 23 determines whether the displacement portion 86 is located at the first position P11, similar to steps S21 and S31. When the control unit 23 determines that the displacement portion 86 is located at the first position P11, the control unit 23 causes the processing to proceed to step S42. That is, when the displacement portion 86 is already located at the first position P11 in both the case where the job is started and the case where the job is not started, the control unit 23 causes the processing to proceed to step S42. When the control unit 23 determines that the displacement portion 86 is not located at the first position P11, the control unit 23 causes the processing to proceed to step S43. That is, when the displacement portion 86 is located at the second position P12 when the job is started, the control unit 23 causes the processing to proceed to step S43.

In step S42, the control unit 23 determines whether a tip end of a medium is not detected based on a detection result received from the medium detection unit 59 until a first period of time elapses after the forward rotation driving of the driving unit 65 is performed. The first period of time is a determination reference time for a feeding error. The determination reference time for the feeding error is a period of time with the forward rotation driving of the driving unit 65 as a starting point. When the control unit 23 determines that the tip end of the medium has been detected until the first period of time elapses after the forward rotation driving of the driving unit 65 is performed, the control unit 23 does not execute step S44 and terminates the medium feeding monitoring processing. When the control unit 23 determines that the tip end of the medium has not been detected until the first period of time elapses after the forward rotation driving of the driving unit 65 is performed, the control unit 23 causes the processing to proceed to step S44.

In step S43, the control unit 23 determines whether the tip end of the medium has not been detected based on a detection result received from the medium detection unit 59 until a second period of time elapses after the forward rotation driving of the driving unit 65 is performed. The second period of time is a determination reference time for a feeding error. The second period of time is a time longer than the first period of time. The second period of time is longer than the first period of time by an estimated period of time for displacing the displacement portion 86 from the second position P12 to the first position P11. When the control unit 23 determines that the tip end of the medium has been detected until the second period of time elapses after the forward rotation driving of the driving unit 65 is performed, the control unit 23 does not execute step S44 and terminates the medium feeding monitoring processing. When the control unit 23 determines that the tip end of the medium has not been detected until the second period of time elapses after the forward rotation driving of the driving unit 65 is performed, the control unit 23 causes the processing to proceed to step S44.

In step S44, the control unit 23 executes feeding error determination processing. In the feeding error determination processing, the control unit 23 determines that a feeding error has occurred. In this case, the control unit 23 displays an image indicating the occurrence of the feeding error on the display unit 35. The control unit 23 may terminate the feeding processing. When the feeding error determination processing is terminated, the control unit 23 terminates the medium feeding monitoring processing.

In this manner, when the displacement portion 86 is located at the first position P11, the control unit 23 determines that a feeding error has occurred when the tip end of the medium has not been detected by the medium detection unit 59 even after the first period of time has elapsed since the driving of the driving unit 65 has been started in order to feed the medium. When the displacement portion 86 is located at the second position P12, the control unit 23 determines that a feeding error has occurred when the tip end of the medium has not been detected by the medium detection unit 59 even after the second period of time longer than the first period of time has elapsed since the driving of the driving unit 65 has been started in order to feed the medium.

When the control unit 23 determines that the displacement portion 86 is already located at the first position P11, the control unit 23 starts to feed the medium without going through a period of time for displacing the displacement portion 86 from the second position P12 to the first position P11. When the control unit 23 determines in step S41 that the displacement portion 86 is located at the second position P12, the control unit 23 starts to feed the medium after a period of time for displacing the displacement portion 86 from the second position P12 to the first position P11 has elapsed. Thereby, the determination reference time for the feeding error is longer when it is determined that the displacement portion 86 is located at the second position P12 than when it is determined that the displacement portion 86 is already located at the first position P11, with the forward rotation driving of the driving unit 65 as a starting point.

Operations and Effects of First Embodiment

Operations and effects of the first embodiment will be described.

(1-1) The feeding roller 63 feeds a medium placed at the medium placement portion 54 by forward rotation power supplied from the driving unit 65. The displacement portion 86 displaces the feeding roller 63 to an abutting position by forward rotation power supplied from the driving unit 65, and displaces the feeding roller 63 to a separation position by reverse rotation power supplied from the driving unit 65. The power transmission unit 66 includes the gear 77 which is a one-way clutch that transmits forward rotation power, which is supplied from the driving unit 65, to the feeding roller 63 but does not transmit reverse rotation power, which is supplied from the driving unit 65, to the feeding roller 63. According to this configuration, it is possible to cause the displacement portion 86 to displace the feeding roller 63 to a separation position without causing the gear 77 to transmit reverse rotation power to the feeding roller 63 by reverse rotation power supplied from the driving unit 65. Thereby, it is possible to displace the feeding roller 63 to the separation position without rotating the feeding roller 63. Thus, it is possible to suppress bleed marks caused by the feeding roller 63 and to improve the alignment of a medium in contact with the feeding roller 63.

(1-2) The displacement portion 86 is displaceable between the first position P11 and the second position P12. The first position P11 is a position at which the feeding roller 63 is displaced to an abutting position, and the second position P12 is a position at which the feeding roller 63 is displaced to a separation position. The first regulating portion 87A regulates the displacement of the displacement portion 86 at the first position P11 when the displacement portion 86 is displaced from the second position P12 to the first position P11. When the displacement portion 86 is displaced from the first position P11 to the second position P12, the second regulating portion 87B regulates displacement of the displacement portion 86 at the second position P12. The second power transmission unit 69 includes the torque limiter 80 that transmits power, which is supplied from the driving unit 65, to the displacement portion 86 and interrupts the transmission of power by a predetermined load. When the displacement of the displacement portion 86 is regulated by the first regulating portion 87A at the first position P11, the torque limiter 80 interrupts the transmission of power to the displacement portion 86. When the displacement of the displacement portion 86 is regulated by the second regulating portion 87B at the second position P12, the torque limiter 80 interrupts the transmission of power to the displacement portion 86. According to this configuration, when the displacement of the displacement portion 86 is regulated by the first regulating portion 87A at the first position P11, a load equal to or greater than a predetermined load is applied to the torque limiter 80, and thus the torque limiter 80 interrupts the transmission of power to the displacement portion 86. When the displacement of the displacement portion 86 is regulated by the second regulating portion 87B at the second position P12, a load equal to or greater than a predetermined load is applied to the torque limiter 80, and thus the torque limiter 80 interrupts the transmission of power to the displacement portion 86. In this manner, by providing the torque limiter 80, it is possible to suppress a load on the driving unit 65 when driving the feeding roller 63.

In particular, the torque limiter 80 is provided in the second power transmission unit 69 having a power transmission path different from a power transmission path to the feeding roller 63, and thus the torque limiter 80 can be provided further upstream. For this reason, it is possible to suppress a load on the driving unit 65 when driving the feeding roller 63, and it is also possible to shorten a power transmission path between the torque limiter 80 and the displacement portion 86. It is possible to accurately displace the displacement portion 86 to the first position P11 and the second position P12 without providing a detection unit that detects displacement of the displacement portion 86 to the first position P11 and the second position P12. Thus, it is possible to improve the alignment of a medium in contact with the feeding roller 63.

(1-3) The power transmission unit 66 includes the gear 75, and the torque limiter 80 is provided coaxially with the gear 75. The gear 75 may rotate in the same direction as the rotation direction of the feeding roller 63 when a medium placed at the medium placement portion 54 is fed by the feeding roller 63. According to this configuration, the torque limiter 80 is provided in the gear 75 that rotates in the same direction as the rotation direction of the feeding roller 63, and thus it is possible to increase a moment for the rotation direction of the feeding roller 63. Thereby, a driving force of the feeding roller 63 can be improved. Thus, the reliability of feeding a medium can be improved.

(1-4) The displacement portion 86 rotates from the second position P12 to the first position P11 by forward rotation power supplied from the driving unit 65. The second rotation shaft 85 which is a rotation shaft of the displacement portion 86 is positioned coaxially with the first rotation shaft 63A which is a rotation shaft of the feeding roller 63. According to this configuration, it is possible to achieve a reduction in the size of the displacement portion 86. Thus, it is possible to achieve a reduction in the size of the device and improve the alignment of a medium in contact with the feeding roller 63.

(1-5) The arm portion 64 supports the feeding roller 63 in a swingable manner. According to this configuration, it is possible to suppress vibration of the feeding roller 63. In particular, in the related art, when a feeding roller and a displacement portion are directly interlocked with each other, it is not easy to support the feeding roller in a swingable manner. Consequently, the torque limiter 80 is provided in the second power transmission unit 69 different from the feeding roller 63, and thus it is possible to support the feeding roller 63 in a swingable manner.

(1-6) The arm portion 64 is rotatable to change a distance between the feeding roller 63 and the medium placement portion 54. According to this configuration, it is possible to change a distance between the feeding roller 63 and a medium placed at the medium placement portion 54 by rotating the arm portion 64. For this reason, the arm portion 64 rotates in accordance with the thickness of a medium and the number of media placed on the medium placement portion 54, and thus it is possible to provide diversity for a medium to be placed on the medium placement portion 54. Thus, it is possible to improve the convenience for the user.

(1-7) The driving shaft 62 rotatably supports the arm portion 64, and the arm portion 64 is attachable to and detachable from the driving shaft 62. According to this configuration, it is possible to easily replace the feeding roller 63 by removing the arm portion 64 from the driving shaft 62. In particular, when the displacement portion 86 and the power transmission unit 66 are accommodated in the arm portion 64, it is possible to easily replace the displacement portion 86 and the power transmission unit 66 together with the feeding roller 63. That is, it is possible to easily replace a configuration for driving the feeding roller 63 and a configuration for displacing the displacement portion 86.

(1-8) The arm retracting portion 30 retracts the arm portion 64 to a retracted position when the medium placement portion 54 is pulled out in a pull-out direction. According to this configuration, it is possible to prevent the medium placement portion 54 from interfering with the arm portion 64 when the medium placement portion 54 is pulled out.

(1-9) A direction in which the displacement portion 86 is displaced from the second position P12 to the first position P11 is the same direction as a direction along a pull-out direction in which the medium placement portion 54 is pulled out. According to this configuration, even when the medium placement portion 54 is pulled out in a state in which the displacement portion 86 is disposed at the second position P12, the displacement portion 86 is displaceable from the second position P12 to the first position P11 so as to be separated from a medium due to friction with a medium. Thus, even when the medium placement portion 54 is pulled out, it is possible to improve the alignment of the medium in contact with the displacement portion 86.

(1-10) A feeding direction in which the feeding roller 63 feeds a medium is a direction opposite to a pull-out direction in which the medium placement portion 54 is pulled out, and a direction in which the displacement portion 86 is displaced from the first position P11 to the second position P12 is the same as a rotation direction according to forward rotation power supplied from the driving unit 65. According to this configuration, when a medium is fed by the feeding roller 63 in a state in which the displacement portion 86 is located at the second position P12, after the displacement portion 86 is displaced from the second position P12 to the first position P11 by the forward rotation power, the feeding roller 63 feeds the medium by the same forward rotation power. In addition, even when the medium placement portion 54 is pulled out in a state in which the displacement portion 86 is disposed at the second position P12, the displacement portion 86 is displaceable from the second position P12 to the first position P11 so as to be separated from a medium due to friction with the medium. In this manner, the direction in which the displacement portion 86 is displaced from the second position P12 to the first position P11 and the rotation direction in which the feeding roller 63 feeds the medium are based on the same forward rotation power. Thereby, even when the medium placement portion 54 is pulled out, the displacement portion 86 is displaceable from the second position P12 to the first position P11. Thus, even when the medium placement portion 54 is pulled out, it is possible to improve the alignment of the medium in contact with the displacement portion 86.

(1-11) The reversing unit 58 reverses a medium fed by the medium feeding device 60. The recording unit 48 can perform recording on double-sided printable photographic paper 99 as a medium, and can perform recording after a medium is reversed by the reversing unit 58. According to this configuration, it is possible to suppress bleed marks caused by the feeding roller 63 with respect to the double-sided printable photographic paper 99. Thereby, more special effects can be achieved. Specifically, general photographic paper is often configured such that printing is performed on only one side. In this case, a surface on which the feeding roller 63 abuts is a surface opposite to the recorded surface, and bleed marks is less likely to be a problem. However, in the case of the photographic paper 99 in which printing is performed on both sides thereof, recording is also performed on the side on which the feeding roller 63 abuts. For this reason, more special effects can be achieved. Further, there is a possibility that printing quality is more important in printing on photographic paper than in printing on general paper. For this reason, it is possible to achieve more special effects by suppressing bleed marks. The photographic paper 99 is mainly intended to print a photograph and is a sheet suitable for printing a photograph. Being capable of recording on the photographic paper 99 indicates that the recording device 11 corresponds to printing on a sheet suitable for printing photographs as described above.

(1-12) The control unit 23 displaces the displacement portion 86 to the second position P12 when there is no next job for a predetermined period of time after termination of a job for performing recording on a medium and when power is shut off. According to this configuration, the feeding roller 63 can be displaced to a separation position when there is no next job for a predetermined period of time after termination of a job and when power is shut off. With this configuration, the feeding roller 63 is displaced to the separation position at an appropriate timing, and thus it is possible to suppress bleed marks caused by the feeding roller 63.

(1-13) When the displacement portion 86 is located at the first position P11, the control unit 23 determines that a feeding error has occurred when the tip end of a medium has not been detected by the medium detection unit 59 even after a first period of time has elapsed since forward rotation driving of the driving unit 65 has been started in order to feed the medium. When the displacement portion 86 is located at the second position P12, the control unit 23 determines that a feeding error has occurred when the tip end of a medium has not been detected by the medium detection unit 59 even after a second period of time, which is longer than the first period of time, has elapsed since forward rotation driving of the driving unit 65 has been started in order to feed the medium. According to this configuration, when a medium is fed by the feeding roller 63, the feeding roller 63 abuts on the medium after a period of time for which the displacement portion 86 is displaced from the second position P12 to the first position P11 is longer when the displacement portion 86 is located at the second position P12 than when the displacement portion 86 is located at the first position P11. For this reason, when a medium is fed by the feeding roller 63, it is possible to increase the accuracy of determination for a feeding error by making a reference period of time for determining the feeding error longer when the displacement portion 86 is located at the second position P12 than when the displacement portion 86 is located at the first position P11.

(1-14) The feeding roller 63 feeds a medium placed at the medium placement portion 54 by forward rotation power supplied from the driving unit 65. The arm portion 64 displaces the feeding roller 63 between an abutting position at which the feeding roller 63 abuts on the medium placed at the medium placement portion 54 and a separation position at which the feeding roller 63 is separated from the medium placed at the medium placement portion 54. The displacement portion 86 rotates the arm portion 64 so as to displace the feeding roller 63 from the separation position to the abutting position by the forward rotation power supplied from the driving unit 65. The displacement portion 86 rotates the arm portion 64 so as to displace the feeding roller 63 from the abutting position to the separation position by reverse rotation power supplied from the driving unit 65. According to this configuration, the driving of the feeding roller 63 and the displacement portion 86 that displaces the arm portion 64 supporting the feeding roller 63 can be realized with power supplied from the common driving unit 65. Thus, it is possible to suppress bleed marks caused by the feeding roller 63 and to suppress an increase in the size of the device.

(1-15) The main body 21 is configured to be held at a predetermined position with respect to the housing 20. The predetermined position includes a closed position, a first open position, and a second open position. The closed position is a position at which the main body 21 is accommodated in the housing 20. The first open position is a position at which the main body 21 protrudes from the housing 20 toward the front side Y1 by a first distance D1. The second open position is a position at which the main body 21 protrudes from the housing 20 toward the front side Y1 by a second distance D2 longer than the first distance D1. The main body 21 is displaceable between the closed position, the first open position, and the second open position in the front-back direction Y. For this reason, the main body 21 is displaceable between the closed position, the first open position, and the second open position in the front-back direction Y, and the main body 21 can be held at the closed position, the first open position, and the second open position with respect to the housing 20. Thus, it is possible to select the type of open position at which the main body 21 can be held and to improve workability related to the displacement of the main body 21 and the holding of the main body 21.

(1-16) The liquid injection port 42 is exposed when the main body 21 is disposed at an open position. For this reason, the main body 21 is displaced from a closed position to the open position in the front-back direction Y, and thus the liquid injection port 42 mounted on the main body 21 can be exposed. In this manner, the main body 21 is displaced from the closed position to the open position in the front-back direction Y, and thus it is possible to inject liquid into the liquid injection port 42 and to improve workability.

(1-17) The waste liquid mounting portion 45 is mounted on the main body 21 and is exposed when the main body 21 is disposed at an open position. For this reason, the main body 21 is displaced from a closed position to the open position in the front-back direction Y, and thus the waste liquid mounting portion 45 mounted on the main body 21 can be exposed. In this manner, the main body 21 is displaced from the closed position to the open position in the front-back direction Y, and thus it is possible to attach and detach the waste liquid accommodation body 46 to and from the waste liquid mounting portion 45 and to improve workability related to the waste liquid mounting portion 45.

(1-18) At least a portion of the conveyance path 49 is exposed when the main body 21 is located at the second open position. For this reason, the main body 21 is displaced from a closed position to the second open position in the front-back direction Y, and thus at least a portion of the conveyance path 49 mounted on the main body 21 can be exposed. In this manner, the main body 21 is displaced from the closed position to the second open position in the front-back direction Y, and thus it is possible to remove a medium in at least a portion of the conveyance path 49 and to improve workability.

Second Embodiment

Next, a second embodiment will be described. In the following description, repeated description will be omitted or simplified for the same configurations as those in the embodiment that has already been described, and configurations different from those in the embodiment that has already been described will be mainly described.

First Separation Processing

Figure 18:
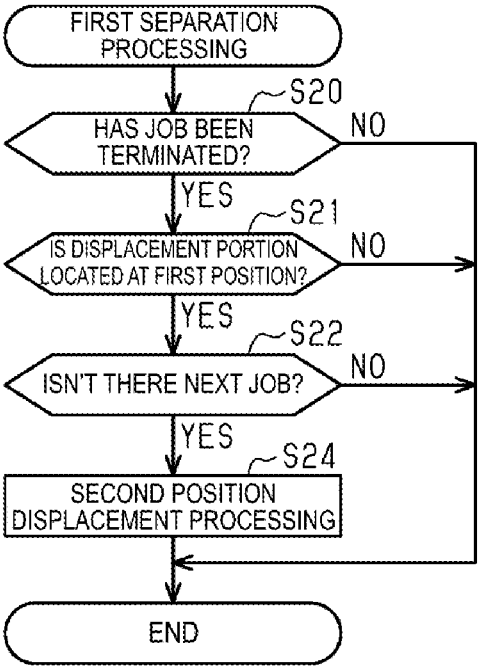
FIG. 18 is a flowchart illustrating first separation processing according to a second embodiment.

As illustrated in FIG. 18, in first separation processing, when a control unit 23 determines in step S22 that there is a next job, the control unit 23 does not execute step S24 and terminates the first separation processing. When the control unit 23 determines that there is no next job, the control unit 23 causes the processing to proceed to step S24. In this manner, the control unit 23 displaces a displacement portion 86 to a second position P12 when there is no job after the termination of a job for performing recording on a medium.

Effects of Second Embodiment

Effects of the second embodiment will be described.

(2-1) The control unit 23 displaces the displacement portion 86 to the second position P12 when there is no job after the termination of a job for performing recording on a medium. According to this configuration, a feeding roller 63 is displaced to a separation position at an appropriate timing, and thus it is possible to suppress bleed marks caused by the feeding roller 63.

Third Embodiment

Next, a third embodiment will be described.

Figure 19:
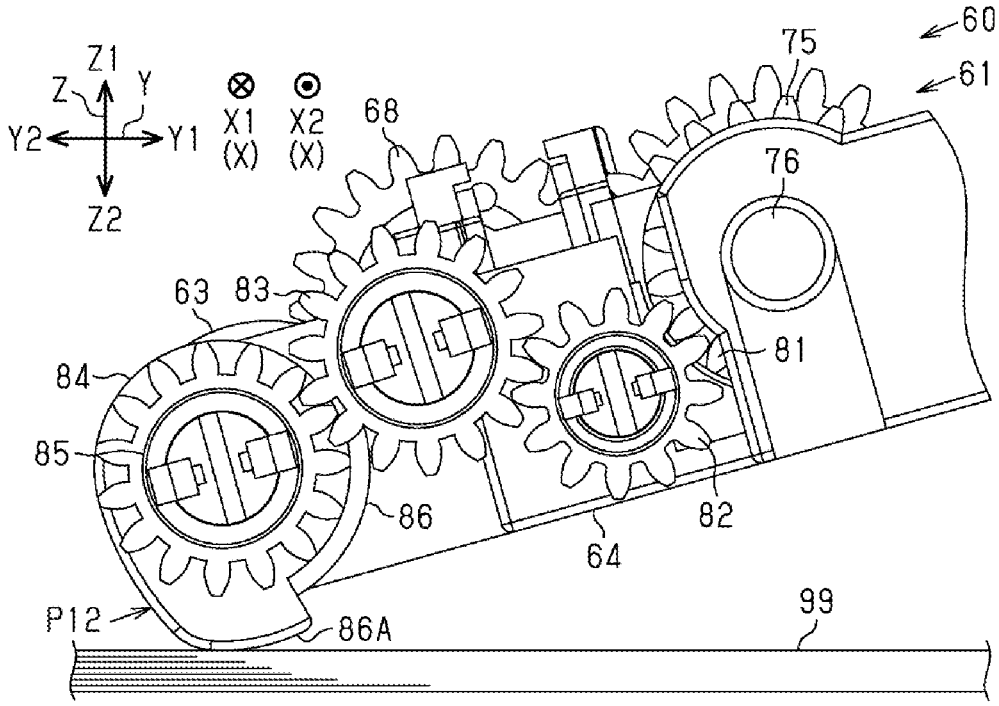
FIG. 19 is a side view illustrating a medium feeding device according to a third embodiment.

As illustrated in FIG. 19, a second rotation shaft 85 of a displacement portion 86 may be closer to a medium than a first rotation shaft 63A of a feeding roller 63. That is, a rotation shaft of the displacement portion 86 may be closer to the medium than a rotation shaft of the feeding roller 63.

Effects of Third Embodiment

Effects of the third embodiment will be described.

(3-1) The rotation shaft of the displacement portion 86 is closer to a medium than the rotation shaft of the feeding roller 63. According to this configuration, it is possible to achieve a reduction in the size of the displacement portion 86. Thus, it is possible to achieve a reduction in the size of the device and to improve the alignment of a medium in contact with the feeding roller 63.

Modification Example

The present embodiment can be implemented with the following modification examples. The present embodiment and the following modification examples can be implemented in combination with each other within a technically consistent range.

In the first embodiment, the predetermined period of time may be a period of time until the device transitions to a power saving mode after termination of a job. The setting of the predetermined period of time may be changeable by a user's instruction.

The control unit 23 may determine whether to execute first separation processing in accordance with a condition such as the type of medium.

The recording device 11 may include a detection unit that detects a medium placed at the medium placement portion 54. In this case, when the control unit 23 determines that no medium is placed on the medium placement portion 54 based on a detection result of the detection unit, the control unit 23 may not displace the displacement portion 86 from the first position P11 to the second position P12 and may continuously dispose the displacement portion 86 at the first position P11. When the control unit 23 determines that a medium is placed on the medium placement portion 54 based on the detection result of the detection unit, the control unit 23 may displace the displacement portion 86 from the first position P11 to the second position P12.

The recording device 11 may displace the displacement portion 86 between the first position P11 and the second position P12 based on a user's instruction. In this case, the control unit 23 may receive an instruction from the operation unit 34 or may receive an instruction from a terminal device which is not illustrated in the drawing.

The medium feeding device 60 may include a detection unit that detects that the displacement portion 86 is located at the first position P11. The medium feeding device 60 may include a detection unit that detects that the displacement portion 86 is located at the second position P12. In this case, the medium feeding device 60 may not include the second regulating portion 87B. When the displacement portion 86 is displaced from the first position P11 to the second position P12 based on a detection result of the detection unit, the control unit 23 may stop reverse rotation driving by the driving unit 65.

The torque limiter 80 is not limited to rotating in the same rotation direction as the feeding roller 63 based on forward rotation power, and may rotate in a rotation direction opposite to the rotation direction of the feeding roller 63 based on forward rotation power. Thereby, it is possible to suppress a conveyance force of the feeding roller 63 and to suppress double feeding of a medium.

The torque limiter 80 may be provided in the second rotation shaft 85. In this case, the displacement portion 86 may be coupled to the torque limiter 80. The second rotation shaft 85 may be provided integrally with the first rotation shaft 63A.

The power transmission unit 66 may include the first power transmission unit 68 and the second power transmission unit 69 instead of including the common power transmission unit 67.

The control unit 23 is not limited to consecutively executing abutting processing and feeding processing, and may stop the driving unit 65 between the abutting processing and the feeding processing, for example.

In the embodiment described above, a serial type printer is adopted as the recording device 11, but the disclosure is not limited thereto. For example, a lateral type printer or a line type printer may be adopted as the recording device 11. The lateral type printer is a printer in which a carriage is movable in two directions of a main scanning direction and a sub-scanning direction. The line printer is a printer that includes a plurality of nozzles lined up at a constant pitch in the width direction X and is capable of simultaneously ejecting liquid across the width of a medium.

A medium is not limited to a sheet. The medium may be a resin film or a sheet, a composite film of a resin and a metal, a laminate film, a woven fabric, a nonwoven fabric, a metal foil, a metal film, a ceramic sheet, clothing, or the like. The medium may not be fed from a roll body.

Liquid can be arbitrarily selected as long as it can be recorded on a medium by adhering to the medium. For example, ink includes various compositions such as an aqueous ink, an oil-based ink, a gel ink, a hot melt ink, or the like, including particles of a functional material made of a solid such as pigments or metal particles dissolved, dispersed or mixed in a solvent.

The recording device 11 is not limited to an inkjet printer, and may be a dot impact printer. A recording method of the recording device 11 may be a laser method instead of an inkjet method.

The expression "at least one" as used in this specification means one or more of desired options. As an example, the expression "at least one" as used in this specification means only one option or both options when the number of options is two. As another example, the expression "at least one" as used in this specification means only one option or a combination of two or more options when the number of options is three or more.

APPENDIX

Hereinafter, technical ideas and effects ascertained from the above-described embodiments and modification examples will be described.

(A) A medium feeding device includes a feeding roller configured to be feed a medium placed at a medium placement portion, a driving unit configured to drive the feeding roller, a displacement portion configured to displace the feeding roller between an abutting position and a separation position, and a power transmission unit configured to be transmit power, that is supplied from the driving unit, to the feeding roller and the displacement portion, in which the abutting position is a position at which the feeding roller abuts on the medium placed at the medium placement portion, the separation position is a position at which the feeding roller is separated from the medium placed at the medium placement portion, the feeding roller feeds the medium placed at the medium placement portion by forward rotation power supplied from the driving unit, and the displacement portion displaces the feeding roller to the abutting position by the forward rotation power supplied from the driving unit and displaces the feeding roller to the separation position by reverse rotation power supplied from the driving unit, and the power transmission unit includes a one-way clutch that transmits the forward rotation power supplied from the driving unit to the feeding roller but does not transmit the reverse rotation power supplied from the driving unit to the feeding roller.

According to this configuration, it is possible to cause the displacement portion to displace the feeding roller to the separation position without causing the one-way clutch to transmit the reverse rotation power to the feeding roller by the reverse rotation power supplied from the driving unit. Thereby, it is possible to displace the feeding roller to the separation position without rotating the feeding roller. Thus, it is possible to improve the alignment of a medium in contact with the feeding roller.

(B) The medium feeding device according to (A) may further include a regulating portion configured to regulate displacement of the displacement portion, in which the displacement portion may be displaceable between a first position and a second position, the first position may be a position at which the feeding roller is displaced to the abutting position, the second position may be a position at which the feeding roller is displaced to the separation position, the regulating portion may regulate displacement of the displacement portion at the second position when the displacement portion is displaced from the first position to the second position, and regulate displacement of the displacement portion at the first position when the displacement portion is displaced from the second position to the first position, the power transmission unit may include a first power transmission unit that transmits power, that is supplied from the driving unit, to the feeding roller and a second power transmission unit that transmits power, that is supplied from the driving unit, to the displacement portion, the first power transmission unit may include the one-way clutch, the second power transmission unit may include a torque limiter that interrupts transmission of power by a predetermined load, and the torque limiter may interrupt transmission of power to the displacement portion when displacement of the displacement portion is regulated by the regulating portion at the second position, and interrupt transmission of power to the displacement portion when displacement of the displacement portion is regulated by the regulating portion at the first position.

According to this configuration, when the displacement of the displacement portion is regulated by the regulating portion at the first position and the second position, a load equal to or greater than the predetermined load is applied to the torque limiter in the second power transmission unit, and thus the torque limiter interrupts the transmission of power to the displacement portion. In this manner, by providing the torque limiter, it is possible to suppress a load on the driving unit when driving the feeding roller. In particular, the torque limiter is provided in the second power transmission unit having a power transmission path different from a power transmission path to the feeding roller, and thus the torque limiter can be provided further upstream. For this reason, it is possible to suppress a load on the driving unit when driving the feeding roller. It is possible to accurately displace the displacement portion to the first position and the second position without providing a detection unit that detects displacement of the displacement portion to the first position and the second position. Thus, it is possible to improve the alignment of a medium in contact with the feeding roller.

(C) In the medium feeding device according to (B), the power transmission unit may include a first gear, the torque limiter may be provided coaxially with the first gear, and the first gear may rotate in the same direction as a rotation direction of the feeding roller when the medium placed at the medium placement portion is fed by the feeding roller.

According to this configuration, the torque limiter is provided in the first gear that rotates in the same direction as the rotation direction of the feeding roller, and thus it is possible to increase a moment for the rotation direction of the feeding roller. Thereby, a driving force of the feeding roller can be improved. Thus, the reliability of feeding a medium can be improved.

(D) In the medium feeding device according to any one of (A) to (C), the displacement portion may be displaceable between a first position and a second position by rotation, the first position may be a position at which the feeding roller is displaced to the abutting position, the second position may be a position at which the feeding roller is displaced to the separation position, the displacement portion may rotate from the second position to the first position by the forward rotation power supplied from the driving unit, and a rotation shaft of the displacement portion may be closer to the medium than a rotation shaft of the feeding roller.

According to this configuration, the rotation shaft of the displacement portion is positioned closer to the medium than the rotation shaft of the feeding roller, and thus it is possible to achieve a reduction in the size of the displacement portion. Thus, it is possible to achieve a reduction in the size of the device and improve the alignment of a medium in contact with the feeding roller.

(E) In the medium feeding device according to any one of (A) to (C), the displacement portion may be displaceable between a first position and a second position by rotation, the first position may be a position at which the feeding roller is displaced to the abutting position, the second position may be a position at which the feeding roller is displaced to the separation position, the displacement portion may rotate from the second position to the first position by the forward rotation power supplied from the driving unit, and a rotation shaft of the displacement portion may be positioned coaxially with a rotation shaft of the feeding roller.

According to this configuration, the rotation shaft of the displacement portion is positioned coaxially with the rotation shaft of the feeding roller, and thus it is possible to achieve a reduction in the size of the displacement portion. Thus, it is possible to achieve a reduction in the size of the device and improve the alignment of a medium in contact with the feeding roller.

(F) The medium feeding device according to any one of (A) to (E) may further include an arm portion configured to support the feeding roller in a swingable manner.

With this configuration, it is possible to suppress vibration of the feeding roller.

(G) The medium feeding device according to any one of (A) to (F) may further include an arm portion configured to support the feeding roller and the displacement portion, in which the arm portion may be rotatable to change a distance between the feeding roller and the medium placement portion.

According to this configuration, it is possible to change a distance between the feeding roller and the medium placed at the medium placement portion by rotating the arm portion. For this reason, the arm portion rotates in accordance with the thickness of the medium and the number of media placed on the medium placement portion, and thus it is possible to provide diversity for a medium to be placed on the medium placement portion. Thus, it is possible to improve the convenience for the user.

(H) The medium feeding device according to (F) or (G) may further include a driving shaft configured to rotatably support the arm portion, in which the arm portion is attachable to and detachable from the driving shaft.

According to this configuration, it is possible to easily replace the feeding roller by removing the arm portion from the driving shaft.

(I) The medium feeding device according to any one of (F) to (H) may further include an arm retracting portion configured to retract the arm portion to a retracted position when the medium placement portion is pulled out in a pull-out direction.

According to this configuration, it is possible to prevent the medium placement portion from interfering with the arm portion when the medium placement portion is pulled out.

(J) In the medium feeding device according to any one of (A) to (I), the displacement portion may be displaceable between a first position and a second position, the first position may be a position at which the feeding roller is displaced to the abutting position, the second position may be a position at which the feeding roller is displaced to the separation position, and a direction in which the displacement portion is displaced from the second position to the first position may be the same direction as a direction along a pull-out direction in which the medium placement portion is pulled out.

According to this configuration, even when the medium placement portion is pulled out in a state in which the displacement portion is disposed at the second position, the displacement portion is displaceable from the second position to the first position so as to be separated from the medium due to friction with the medium. Thus, even when the medium placement portion is pulled out, it is possible to improve the alignment of the medium in contact with the displacement portion.

(K) In the medium feeding device according to any one of (A) to (J), a feeding direction in which the feeding roller feeds the medium may be a direction opposite to the pull-out direction, and a direction in which the displacement portion is displaced from the first position to the second position may be the same as a direction of rotation of the feeding roller caused by the forward rotation power supplied from the driving unit.

According to this configuration, when the medium is fed by the feeding roller in a state in which the displacement portion is located at the second position, after the displacement portion is displaced from the second position to the first position by the forward rotation power, the feeding roller feeds the medium by the same forward rotation power. In addition, even when the medium placement portion is pulled out in a state in which the displacement portion is disposed at the second position, the displacement portion is displaceable from the second position to the first position so as to be separated from the medium due to friction with the medium. In this manner, the direction in which the displacement portion is displaced from the second position to the first position and the rotation direction in which the feeding roller feeds the medium are based on the same forward rotation power, and thus even when the medium placement portion is pulled out, the displacement portion is displaceable from the second position to the first position. Thus, even when the medium placement portion is pulled out, it is possible to improve the alignment of the medium in contact with the displacement portion.

(L) A recording device includes the medium feeding device according to any one of (A) to (K), and a recording unit configured to perform recording on a medium fed by the feeding roller. According to this configuration, the same effects as in (A) can be exhibited.

(M) The recording device according to (L) may further include a reversing unit configured to reverse the medium fed by the medium feeding device, in which the recording unit may be configured to perform recording on double-sided printable photographic paper as a medium, and is configured to perform recording after the medium is reversed by the reversing unit.

According to this configuration, it is possible to suppress bleed marks caused by the feeding roller with respect to the double-sided printable photographic paper. Thereby, more special effects can be achieved.

(N) The recording device according to (L) or (M) may further include a control unit, in which the displacement portion may be displaceable between a first position and a second position, the first position may be a position at which the feeding roller is displaced to the abutting position, the second position may be a position at which the feeding roller is displaced to the separation position, and the control unit may displace the displacement portion to the second position in at least one of a case in which there is no job after termination of a job for performing recording on a medium, a case in which there is no next job for a predetermined period of time after termination of a job for performing recording on a medium, and a case in which power is shut off.

According to this configuration, the feeding roller can be displaced to a separation position in at least any one of a case in which there is no job after termination of a job and a case in which power is shut off. With this configuration, the feeding roller is displaced to the separation position at an appropriate timing, and thus it is possible to suppress bleed marks caused by the feeding roller.

(O) The recording device according to any one of (L) to (N) may further include a control unit and a medium detection unit configured to detect a tip end of the medium fed by the feeding roller, in which the displacement portion may be displaceable between a first position and a second position, the first position may be a position at which the feeding roller is displaced to the abutting position, the second position may be a position at which the feeding roller is displaced to the separation position, and the control unit may determine occurrence of a feeding error when the tip end of the medium is not detected by the medium detection unit even after a first period of time elapses from the time when driving of the driving unit was started in order to feed the medium when the displacement portion is located at the first position, and determine occurrence of a feeding error when the tip end of the medium is not detected by the medium detection unit even after a second period of time longer than the first period of time elapses from the time when driving of the driving unit was started in order to feed the medium when the displacement portion is located at the second position.

According to this configuration, when the medium is fed by the feeding roller, the feeding roller abuts on the medium after a period of time for which the displacement portion is displaced from the second position to the first position is longer when the displacement portion is located at the second position than when the displacement portion is located at the first position. For this reason, when the medium is fed by the feeding roller, it is possible to increase the accuracy of determination for a feeding error by making a reference period of time for determining the feeding error longer when the displacement portion is located at the second position than when the displacement portion is located at the first position.

(P) A feeding roller unit includes a feeding roller configured to be feed a medium placed at a medium placement portion, a displacement portion configured to displace the feeding roller between an abutting position and a separation position, and a power transmission unit configured to transmit power, that is supplied from a driving unit, to the feeding roller and the displacement portion, in which the abutting position may be a position at which the feeding roller abuts on the medium placed at the medium placement portion, the separation position may be a position at which the feeding roller is separated from the medium placed at the medium placement portion, the feeding roller may feed the medium placed at the medium placement portion by forward rotation power supplied from the driving unit, and the displacement portion may displace the feeding roller to the abutting position by the forward rotation power supplied from the driving unit and displaces the feeding roller to the separation position by reverse rotation power supplied from the driving unit, and the power transmission unit may include a one-way clutch that transmits the forward rotation power supplied from the driving unit to the feeding roller but does not transmit the reverse rotation power supplied from the driving unit to the feeding roller. According to this configuration, the same effects as in (A) can be exhibited.

(Q) In a method of controlling the recording device according to (L) or (M), the displacement portion is displaceable between a first position and a second position, the first position is a position at which the feeding roller is displaced to the abutting position, the second position is a position at which the feeding roller is displaced to the separation position, and the method comprises displacing the displacement portion to the second position in at least one of a case in which there is no job after termination of a job for performing recording on a medium, a case in which there is no next job for a predetermined period of time after termination of a job for performing recording on a medium, and a case in which power is shut off. According to this configuration, the same effects as in (N) can be exhibited.

(R) In the method of controlling the recording device according to (Q), the recording device may include a medium detection unit that detects a tip end of the medium fed by the feeding roller, and the method may further include determining occurrence of a feeding error when the tip end of the medium is not detected by the medium detection unit even after a first period of time elapses from the time when driving of the driving unit was started in order to feed the medium when the displacement portion is located at the first position, and determining occurrence of a feeding error when the tip end of the medium is not detected by the medium detection unit even after a second period of time longer than the first period of time elapses from the time when driving of the driving unit was started in order to feed the medium when the displacement portion is located at the second position. According to this configuration, the same effects as in (O) can be exhibited.

What is claimed is:

1. A medium feeding device comprising:

a feeding roller configured to feed a medium placed at a medium placement portion;

a driving unit configured to drive the feeding roller;

a displacement cam configured to displace the feeding roller between an abutting position and a separation position;

an arm portion configured to support the feeding roller and the displacement cam; and a power transmission unit configured to transmit power, that is supplied from the driving unit, to the feeding roller and the displacement cam, wherein the abutting position is a position at which the feeding roller abuts on the medium placed at the medium placement portion, the separation position is a position at which the feeding roller is separated from the medium placed at the medium placement portion, the feeding roller feeds the medium placed at the medium placement portion by forward rotation power supplied from the driving unit, the displacement cam displaces the feeding roller to the abutting position by the forward rotation power supplied from the driving unit and displaces the feeding roller to the separation position by reverse rotation power supplied from the driving unit, and the power transmission unit includes a one-way clutch that transmits the forward rotation power supplied from the driving unit to the feeding roller but does not transmit the reverse rotation power supplied from the driving unit to the feeding roller, and the arm portion is rotatable to change a distance between the feeding roller and the medium placement portion.

2. The medium feeding device according to claim 1, further comprising:

a regulator configured to regulate displacement of the displacement cam, wherein the displacement cam is displaceable between a first position and a second position, the first position is a position at which the feeding roller is displaced to the abutting position, the second position is a position at which the feeding roller is displaced to the separation position, the regulator regulates displacement of the displacement cam at the second position when the displacement cam is displaced from the first position to the second position, and regulates displacement of the displacement cam at the first position when the displacement cam is displaced from the second position to the first position, the power transmission unit includes a first power transmission unit that transmits power, that is supplied from the driving unit, to the feeding roller and a second power transmission unit that transmits power, that is supplied from the driving unit, to the displacement cam, the first power transmission unit includes the one-way clutch, the second power transmission unit includes a torque limiter that interrupts transmission of power by a predetermined load, and the torque limiter interrupts transmission of power to the displacement cam when displacement of the displacement cam is regulated by the regulator at the second position, and interrupts transmission of power to the displacement cam when displacement of the displacement cam is regulated by the regulator at the first position.

3. The medium feeding device according to claim 2, wherein the power transmission unit includes a first gear, the torque limiter is provided coaxially with the first gear, and the first gear rotates in the same direction as a rotation direction of the feeding roller when the medium placed at the medium placement portion is fed by the feeding roller.

4. The medium feeding device according to claim 1, wherein the displacement cam is displaceable between a first position and a second position by rotation, the first position is a position at which the feeding roller is displaced to the abutting position, the second position is a position at which the feeding roller is displaced to the separation position, the displacement cam rotates from the second position to the first position by the forward rotation power supplied from the driving unit, and a rotation shaft of the displacement cam is closer to the medium than a rotation shaft of the feeding roller.

5. The medium feeding device according to claim 1, wherein the displacement cam is displaceable between a first position and a second position by rotation, the first position is a position at which the feeding roller is displaced to the abutting position, the second position is a position at which the feeding roller is displaced to the separation position, the displacement cam rotates from the second position to the first position by the forward rotation power supplied from the driving unit, and a rotation shaft of the displacement cam is positioned coaxially with a rotation shaft of the feeding roller.

6. The medium feeding device according to claim 1, further comprising:

a driving shaft configured to rotatably support the arm portion, wherein the arm portion is attachable to and detachable from the driving shaft.

7. The medium feeding device according to claim 1, further comprising:

an arm retracting portion configured to retract the arm portion to a retracted position when the medium placement portion is pulled out in a pull-out direction.

8. The medium feeding device according to claim 1, wherein the displacement cam is displaceable between a first position and a second position, the first position is a position at which the feeding roller is displaced to the abutting position, the second position is a position at which the feeding roller is displaced to the separation position, and a direction in which the displacement cam is displaced from the second position to the first position is the same direction as a direction along a pull-out direction in which the medium placement portion is pulled out.

9. The medium feeding device according to claim 8, wherein a feeding direction in which the feeding roller feeds the medium is a direction opposite to the pull-out direction, and a direction in which the displacement cam is displaced from the first position to the second position is the same as a direction of rotation of the feeding roller caused by the forward rotation power supplied from the driving unit.

10. A recording device comprising:

the medium feeding device according to claim 1; and a recording unit configured to perform recording on a medium fed by the feeding roller.

11. The recording device according to claim 10, further comprising:

a reversing unit configured to reverse the medium fed by the medium feeding device, wherein the recording unit is configured to perform recording on double-sided printable photographic paper as a medium, and is configured to perform recording after the medium is reversed by the reversing unit.

12. The recording device according to claim 10, further comprising:

a control unit, wherein the displacement cam is displaceable between a first position and a second position, the first position is a position at which the feeding roller is displaced to the abutting position, the second position is a position at which the feeding roller is displaced to the separation position, and the control unit displaces the displacement cam to the second position in at least one of a case in which there is no job after termination of a job for performing recording on a medium, a case in which there is no job for a predetermined period of time after termination of a job for performing recording on a medium, and a case in which power is shut off.

13. The recording device according to claim 10, further comprising:

a control unit; and a medium detection unit configured to detect a tip end of the medium fed by the feeding roller, wherein the displacement cam is displaceable between a first position and a second position, the first position is a position at which the feeding roller is displaced to the abutting position, the second position is a position at which the feeding roller is displaced to the separation position, and the control unit determines occurrence of a feeding error when the tip end of the medium is not detected by the medium detection unit even after a first period of time elapses from the time when driving of the driving unit is started to feed the medium when the displacement cam is located at the first position, and determines occurrence of a feeding error when the tip end of the medium is not detected by the medium detection unit even after a second period of time longer than the first period of time elapses from the time when driving of the driving unit is started to feed the medium when the displacement cam is located at the second position.

14. A feeding roller unit comprising:

a feeding roller configured to feed a medium placed at a medium placement portion;

a displacement cam configured to displace the feeding roller between an abutting position and a separation position;

an arm portion configured to support the feeding roller and the displacement cam; and a power transmission unit configured to transmit power, that is supplied from a driving unit, to the feeding roller and the displacement cam, wherein the abutting position is a position at which the feeding roller abuts on the medium placed at the medium placement portion, the separation position is a position at which the feeding roller is separated from the medium placed at the medium placement portion, the feeding roller feeds the medium placed at the medium placement portion by forward rotation power supplied from the driving unit, the displacement cam displaces the feeding roller to the abutting position by the forward rotation power supplied from the driving unit and displaces the feeding roller to the separation position by reverse rotation power supplied from the driving unit, and the power transmission unit includes a one-way clutch that transmits the forward rotation power supplied from the driving unit to the feeding roller but does not transmit the reverse rotation power supplied from the driving unit to the feeding roller, and the arm portion is rotatable to change a distance between the feeding roller and the medium placement portion.

15. A method of controlling the recording device according to claim 10, wherein the displacement cam is displaceable between a first position and a second position, the first position is a position at which the feeding roller is displaced to the abutting position, the second position is a position at which the feeding roller is displaced to the separation position, and p1 the method comprises displacing the displacement cam to the second position in at least one of a case in which there is no job after termination of a job for performing recording on a medium, a case in which there is no next job for a predetermined period of time after termination of a job for performing recording on a medium, and a case in which power is shut off.

16. The method of controlling the recording device according to claim 15, wherein the recording device includes a medium detection unit that detects a tip end of the medium fed by the feeding roller, and the method further comprises;

determining occurrence of a feeding error when the tip end of the medium is not detected by the medium detection unit even after a first period of time elapses from the time when driving of the driving unit is started to feed the medium when the displacement cam is located at the first position; and determining occurrence of a feeding error when the tip end of the medium is not detected by the medium detection unit even after a second period of time longer than the first period of time elapses from the time when driving of the driving unit is started to feed the medium when the displacement cam is located at the second position.

17. A medium feeding device comprising:

a feeding roller configured to feed a medium placed at a medium placement portion;

a driving unit configured to drive the feeding roller;

a displacement cam configured to displace the feeding roller between an abutting position and a separation position;

a power transmission unit configured to transmit power, that is supplied from the driving unit, to the feeding roller and the displacement cam; and a regulator configured to regulate displacement of the displacement cam, wherein the abutting position is a position at which the feeding roller abuts on the medium placed at the medium placement portion, the separation position is a position at which the feeding roller is separated from the medium placed at the medium placement portion, the feeding roller feeds the medium placed at the medium placement portion by forward rotation power supplied from the driving unit, the displacement cam displaces the feeding roller to the abutting position by the forward rotation power supplied from the driving unit and displaces the feeding roller to the separation position by reverse rotation power supplied from the driving unit, and the power transmission unit includes a one-way clutch that transmits the forward rotation power supplied from the driving unit to the feeding roller but does not transmit the reverse rotation power supplied from the driving unit to the feeding roller, the displacement cam is displaceable between a first position and a second position, the first position is a position at which the feeding roller is displaced to the abutting position, the second position is a position at which the feeding roller is displaced to the separation position, the regulator regulates displacement of the displacement cam at the second position when the displacement cam is displaced from the first position to the second position, and regulates displacement of the displacement cam at the first position when the displacement cam is displaced from the second position to the first position, the power transmission unit includes a first power transmission unit that transmits power, that is supplied from the driving unit, to the feeding roller and a second power transmission unit that transmits power, that is supplied from the driving unit, to the displacement cam, the first power transmission unit includes the one-way clutch, the second power transmission unit includes a torque limiter that interrupts transmission of power by a predetermined load, and the torque limiter interrupts transmission of power to the displacement cam when displacement of the displacement cam is regulated by the regulator at the second position, and interrupts transmission of power to the displacement cam when displacement of the displacement cam is regulated by the regulator at the first position.

* * * * *